US007544456B2

(12) United States Patent
Mitsuhashi et al.

(10) Patent No.: US 7,544,456 B2
(45) Date of Patent: Jun. 9, 2009

(54) TONER FOR DEVELOPING ELECTROSTATIC CHARGE IMAGE

(75) Inventors: Kazuo Mitsuhashi, Joetsu (JP); Masatoshi Murayama, Joetsu (JP)

(73) Assignee: Mitsubishi Chemical Corporation, Tokyo (JP)

( * ) Notice: Subject to any disclaimer, the term of this patent is extended or adjusted under 35 U.S.C. 154(b) by 50 days.

(21) Appl. No.: 11/332,251

(22) Filed: Jan. 17, 2006

(65) Prior Publication Data

US 2006/0115760 A1 Jun. 1, 2006

Related U.S. Application Data

(63) Continuation of application No. PCT/JP2004/010561, filed on Jul. 16, 2004.

(30) Foreign Application Priority Data

Jul. 16, 2003 (JP) ..... 2003-197996

(51) Int. Cl.
*G03G 9/083* (2006.01)

(52) U.S. Cl. ..... 430/108.1; 430/109.4

(58) Field of Classification Search ..... 430/108.1, 430/109.4
See application file for complete search history.

(56) References Cited

U.S. PATENT DOCUMENTS

| | | | | |
|---|---|---|---|---|
| 4,904,562 | A * | 2/1990 | Yusa et al. | 430/138 |
| 5,635,325 | A | 6/1997 | Inaba et al. | |
| 6,037,090 | A * | 3/2000 | Tanaka et al. | 430/109.4 |
| 6,395,442 | B1 | 5/2002 | Hayashi et al. | |
| 2002/0006569 | A1 | 1/2002 | Akai et al. | |
| 2002/0012863 | A1 | 1/2002 | Akai et al. | |
| 2003/0118930 | A1 * | 6/2003 | Suwa et al. | 430/108.8 |

FOREIGN PATENT DOCUMENTS

| | | |
|---|---|---|
| JP | 60-103357 | 6/1985 |
| JP | 63-38951 | 2/1988 |
| JP | 8-50368 | 2/1996 |
| JP | 9-269610 | 10/1997 |
| JP | 11-72958 | 3/1999 |
| JP | 2000-98662 | 4/2000 |
| JP | 2001-027821 | 1/2001 |
| JP | 2001-042564 | 2/2001 |
| JP | 2002-196525 | 7/2002 |
| JP | 2003-043732 | 2/2003 |
| JP | 2003-057875 | 2/2003 |
| JP | 2003-107777 | 4/2003 |
| JP | 2003-195555 | 7/2003 |

OTHER PUBLICATIONS

Avallone, E.A.; Baumeister, T., III (1996). Marks' Standard Handbook for Mechanical Engineers (10th Edition). McGraw-Hill. (Table 6.12.1).*

* cited by examiner

*Primary Examiner*—Mark F Huff
*Assistant Examiner*—Peter L Vajda
(74) *Attorney, Agent, or Firm*—Oblon, Spivak, McClelland, Maier & Neustadt, P.C.

(57) ABSTRACT

A toner for developing an electrostatic charge image, comprising particles containing a binder resin and a colorant, characterized in that the particles contain a fixing aid having a melting point of from to 30 to 100° C. and a surface tension of at least 39 mN/m, and the fixing aid is present with an average particle diameter of at most 1 μm in the particles, which toner can realize low-temperature fixing with a wide fixing temperature range, is excellent in fixing strength, presents little soiling onto a photoreceptor and is free from soiling in the interior of the apparatus due to electrostatic deterioration, can realize low temperature-fixing even in the case of forming a full-color image and yet, is excellent in fixing strength, provides good surface smoothness during fixing and good transparency, and provides high mechanical durability even when used in non-magnetic one component development systems.

19 Claims, No Drawings

TONER FOR DEVELOPING ELECTROSTATIC CHARGE IMAGE

TECHNICAL FIELD

The present invention relates to a toner for developing an electrostatic charge image, which is useful for e.g. a copying machine and a printer of an electrophotographic system. More particularly, it relates to a toner for developing an electrostatic charge image, which is excellent in low temperature fixing properties and fixing strength, presents little filming onto a photoreceptor, etc., and is excellent in transparency and surface smoothness during the fixing.

BACKGROUND ART

In recent years, in order to accomplish microsizing, high speed and energy saving for an image-forming apparatus employing electrophotography, the toner for developing an electrostatic charge image to be used for such an apparatus, is required to have low temperature fixing properties. In order to improve the low temperature fixing properties of a toner, it is important not only to lower the lower limit of the fixing temperature but also to broaden the fixing temperature range of the toner. Heretofore, in order to accomplish such objects, it has been attempted to use a component having a relatively low molecular weight and a component having a relatively high molecular weight in combination as the binder resin containing the toner. However, in such a method, the low molecular weight component has sometimes caused deterioration of the electrostatic property of the toner. Further, there has been a problem that when such a toner is used for a long period of time, the low molecular weight component tends to soil the carrier, photoreceptor, developing blade, etc., whereby no clear images have been obtained.

Further, it has been attempted to improve the low temperature fixing properties of a toner by incorporating wax to the toner. If wax is incorporated to the toner, it is possible to prevent the toner softened during the fixing from fusing to the fixing roller, whereby a wide fixing temperature range can be secured. Particularly, with a toner prepared by an emulsion polymerization flocculation method (e.g. JP-A-9-190012) or a toner obtained by a suspension polymerization method (e.g. JP-A-8-050368), the content of wax in the toner can be increased, as compared with the toner obtained by a melt kneading pulverization method. If a toner containing wax is produced by a wet system polymerization method such as an emulsion polymerization flocculation method or a suspension polymerization method, it is possible to obtain a toner which can realize relatively low temperature fixing. However, if wax is incorporated in a large amount in the toner, in many cases, the wax tends to leach out on the toner surface. And, the leached out wax tends to cause deterioration of the electrostatic property of the toner. Further, there has been a problem that if a toner containing a large amount of wax is used for a long period of time, wax leached out from the toner tends to soil components of the apparatus such as the carrier, photoreceptor and developing blade, whereby clear images can hardly be obtainable. Further, excessive wax hinders fixing of the toner on the fixing substrate such as paper, thus leading to deterioration of the fixing strength. From this viewpoint, among conventional waxes, there has been one having a release property with a view to preventing offset (fusion) to the fixing roller, but there has been none which has affinity to the fixing substrate such as paper and which has a reinforcing effect at the time of fixing the toner.

Further, in a case where a full-color image is to be formed by superimposing toners of various colors such as cyan, magenta, yellow and black, it becomes more important to secure a wide fixing temperature range and to improve the fixing strength to the fixing substrate.

Further, in recent years, as a developing system, a non-magnetic one component system has been used in many cases. In the case of this system, the mechanical stress is high when the toner is formed into a thin layer on a developing roller. Accordingly, in the case of the non-magnetic one component system, the above-mentioned various problems resulting from leaching of wax or a low molecular weight component in the binder resin from the toner, have been more distinct. Especially in a case where an organic photoconductor (hereinafter sometimes referred to simply as OPC) is used, and development is carried out by pressing a thin layer of the toner on the developing roller directly against OPC, i.e. in a case where so-called contact phenomenon is employed, wax or a low molecular weight component in the binder resin tends to cause filming on OPC, thus leading to a fatal trouble. As a method to prevent leaching of such a component from the toner, a method of increasing the molecular weight of a high molecular weight component in the binder resin is conceivable, but in such a case, the low temperature fixing properties tend to deteriorate. Consequently, it has been difficult to satisfy both the durability and the fixing properties of the toner. Thus, it has not been known heretofore how to obtain a toner which has a good low temperature fixing property, a wide fixing temperature range and high fixing strength and which is stable in the electrostatic property even when it is used for a long period of time and free from soiling of the apparatus.

DISCLOSURE OF THE INVENTION

The present invention has been made in view of the above-mentioned prior art, and it is an object of the present invention to provide the following toner.

(1) It can realize low temperature fixing, has a wide fixing temperature range and yet is excellent in the fixing strength.

(2) It presents little soiling such as filming on a photoreceptor.

(3) It is free from soiling in the interior of the apparatus due to deterioration of the electrostatic property.

(4) Even in the case of superimposing a plurality of colors to form a full color image, it enables low temperature fixing, and yet it is excellent in the fixing strength and provides good transparency with good surface smoothness during the fixing.

(5) It provides high mechanical durability in use in a non-magnetic one component development system or in use in a contact development system.

As a result of an extensive study, the present inventors have found it possible to solve the above problems by incorporating a fixing aid having a certain specific surface tension with a specific particle diameter into the particles constituting a toner for developing an electrostatic charge image, and have arrived at the present invention. Namely, the present invention provides a toner for developing an electrostatic charge image, comprising particles containing a binder resin and a colorant, characterized in that the particles contain a fixing aid having a melting point of from 30 to 100° C. and a surface tension of at least 39 mN/m, and the fixing aid is present with an average particle diameter of at most 1 μm in the particles.

According to the present invention, it is possible to provide a toner for developing an electrostatic charge image, which can realize low temperature fixing, has a wide fixing temperature range and yet is excellent in the fixing strength and which presents little soiling such as filming on a photoreceptor and is free from soiling of the interior of the apparatus due to deterioration of the electrostatic property. Further, it is possible to provide a toner for developing an electrostatic charge image, which can realize low temperature fixing even in the case of forming a full color image and yet is excellent in the fixing strength and which provides good transparency with good surface smoothness during the fixing. Further, it is possible to provide a toner for developing an electrostatic charge image which provides high mechanical durability even in an image-forming method in a non-magnetic one component development system or a contact development system.

BEST MODE FOR CARRYING OUT THE INVENTION

Now, the present invention will be described in detail, but it should be understood that the present invention is by no means restricted to the following embodiments and may be optionally modified within a range not to depart from the concept of the present invention.

The toner for developing an electrostatic charge image of the present invention contains, as its constituting components, at least a binder resin, a fixing aid and a colorant and, if necessary, further contains wax, an electrification-controlling agent, auxiliary fine particles and other additives.

As the binder resin to be used in the present invention, known various resins suitable for toners may be used. For example, a styrene resin, a polyester resin, an epoxy resin, a polyurethane resin, a vinyl chloride resin, a polyethylene, a polypropylene, an ionomer resin, a silicone resin, a rosin-modified maleic resin, a phenol resin, a ketone resin, an ethylene/ethyl acrylate copolymer, and a polyvinylbutyral resin, may be mentioned. It may be their mixture. As a resin to be used particularly preferably in the present invention, a styrene resin may be mentioned. In the case of a resin having high compatibility with the fixing aid among polyester resins, epoxy resins, etc., there may be a case where the glass transition temperature of the toner particles tends to be low and the heat resistance tends to deteriorate, or a case where the low temperature fixing property tends to deteriorate.

The styrene resin may be a homopolymer or a copolymer containing styrene or a styrene-derivative, such as a polystyrene, a chloropolystyrene, a poly-α-methyl styrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer (such as a styrene/methyl acrylate copolymer, a styrene/ethyl acrylate copolymer, a styrene/butyl acrylate copolymer, a styrene/octyl acrylate copolymer or a styrene/phenyl acrylate copolymer), a styrene/acrylate/acrylic acid copolymer (such as a styrene/methyl acrylate/acrylic acid copolymer, a styrene/ethyl acrylate/acrylic acid copolymer, a styrene/butyl acrylate/acrylic acid copolymer, a styrene/octyl acrylate/acrylic acid copolymer or a styrene/phenyl acrylate/acrylic acid copolymer), a styrene/acrylate/methacrylic acid copolymer (such as a styrene/methyl acrylate/methacrylic acid copolymer, a styrene/ethyl acrylate/methacrylic acid copolymer, a styrene/butyl acrylate/methacrylic acid copolymer, a styrene/octyl acrylate/methacrylic acid copolymer or a styrene/phenyl acrylate/methacrylic acid copolymer), a styrene/methacrylate copolymer (such as a styrene/methyl methacrylate copolymer, a styrene/ethyl methacrylate copolymer, a styrene/butyl methacrylate copolymer, a styrene/octyl methacrylate copolymer or a styrene/phenyl methacrylate copolymer), a styrene/mechacrylate/acrylic acid copolymer (such as a styrene/methyl methacrylate/acrylic acid copolymer, a styrene/ethyl methacrylate/acrylic acid copolymer, a styrene/butyl methacrylate/acrylic acid copolymer, a styrene/octyl methacrylate/acrylic acid copolymer or a styrene/phenyl methacrylate/acrylic acid copolymer), a styrene/methacrylate/methacrylic acid copolymer (such as a styrene/methyl methacrylate/methacrylic acid copolymer, a styrene/ethyl methacrylate/methacrylic acid copolymer, a styrene/butyl methacrylate/methacrylic acid copolymer, a styrene/octyl methacrylate/methacrylic acid copolymer or a styrene/phenyl methacrylate/methacrylic acid copolymer), a styrene/methyl α-chloroacrylate copolymer, or a styrene/acrylonitrile/acrylate copolymer. It may be their mixture. Further, one having a part or whole of the above acrylic acid or methacrylic acid substituted by a substituted monocarboxylic acid such as α-chloroacrylic acid or α-bromoacrylic acid, an unsaturated dicarboxylic acid such as fumaric acid, maleic acid, maleic anhydride or monobutyl maleate, an anhydride thereof or a half ester thereof, may also be suitably used.

Among them, it is particularly preferably at least one binder resin selected from the group consisting of a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer and a styrene/methacrylate/methacrylic acid copolymer. It is particularly preferably at least one binder resin having acid groups selected from the group consisting of a styrene/acrylate/acrylic acid copolymer, a styrene/acrylate/methacrylic acid copolymer, a styrene/methacrylate/acrylic acid copolymer and a styrene/methacrylate/methacrylic acid copolymer, since the affinity and dispersibility with the fixing aid is thereby be improved, and it is excellent from the viewpoint of the fixing property and durability when formed into a toner, and yet the electrostatic stability (particularly the negative electrostatic property) of the toner will be thereby improved, such being more preferred. Here, the ester group in the acrylate or the methacrylate is not particularly limited, but a methyl ester, an ethyl ester, a butyl ester, an octyl ester or a phenyl ester may, for example, be mentioned.

With respect to the glass transition temperature (hereinafter sometimes referred to simply as Tg) to be measured by a differential scanning calorimeter (hereinafter sometimes referred to simply as DSC) of the binder resin, the value in accordance with JIS K7121 is preferably from 40 to 80° C., more preferably from 50 to 70° C. If Tg exceeds the above range, low temperature fixing may sometimes tends to be difficult, and during the fixing of a full color toner, the transparency of the toner may sometimes tends to be low. If Tg is less than the above range, the storage stability of the toner may sometimes tend to deteriorate.

The colorant to be used in the present invention is not particularly limited, and various inorganic and organic dyes or pigments which are commonly used as colorants for toners, may be employed. Specifically, it may, for example, be an inorganic pigment, such as a metal powder such as iron powder or copper powder, a metal oxide such as red oxide, a carbon represented by carbon black such as furnace black or lamp black, an acid dye or basic dye, such as a precipitate by a precipitating agent, of an azo dye such as benzidine yellow or benzidine orange, or a dye such as quinoline yellow, acid green or alkali blue, or a precipitate of a dye such as rhodamine, magenta or malachite green by e.g. tannic acid or phosphomolybdic acid, a mordant dye such as a metal salt of a hydroxyanthraquinone, an organic pigment such as a phthalocyanine pigment such as phthalocyanine blue or copper sulfonate phthalocyanine, a quinacridone pigment such as quinacridone red or quinacridone violet, or a dioxane pigment, or a synthetic dye such as aniline black, an azo dye, a naphthoquinone dye, an indigo dye, a nigrosine dye, a phthalocyanine dye, a polymethine dye, a di- or tri-allylmethane dye. These colorants may be used in combination as a mixture of two or more of them.

As the colorants to be used for a full color toner, it is preferred to select them from colorants having high transparency. For yellow, an azo pigment (such as an insoluble monoazo type, an insoluble disazo type or a condensed azo type) or a polycyclic pigment (such as an isoindoline type, an isoindolinone type, a threne type or a quinophthalone type) may, for example, be mentioned; for magenta, an azo type pigment (such as an azolake type, an insoluble monoazo type, an insoluble disazo type or a condensed azo type) or a polycyclic pigment (such as a quinacridone pigment or a perylene pigment) may, for example, be mentioned; and for cyan, a phthalocyanine pigment or a threne type pigment may, for example, be mentioned. The combination of colorants may suitably be selected in consideration of the color, etc. However, as an yellow colorant, at least one member selected from C.I. pigment yellow 74, C.I. pigment 93 and C.I. pigment yellow 155, is particularly preferred; as a magenta colorant, at least one member selected from C.I. pigment red 238, C.I. pigment red 269, C.I. pigment red 57:1, C.I. pigment red 48:2 and C.I. pigment red 122 is particularly preferred; as a cyan colorant, at least one member selected from C.I. pigment blue 15 and C.I. pigment blue 15:3 is particularly preferred; and as a black colorant, furnace method carbon black is particularly preferred.

The content of the above colorant is preferably from 1 to 20 parts by weight, more preferably from 2 to 15 parts by weight, particularly preferably from 3 to 10 parts by weight, per 100 parts by weight of the above binder resin. In a case where two or more colorants are used in combination, the total amount is preferably within the above range.

Further, the above colorant may have magnetism. The magnetic colorant may be a ferromagnetic substance showing ferrimagnetism or ferromagnetism in the vicinity of from 0 to 60° C. which is the operation temperature of copying machines, etc. Specifically, it may, for example, be magnetite ($Fe_3O_4$), maghematite ($\gamma$-$Fe_2O_3$), an intermediate or mixture of magnetite and maghematite, a spinel ferrite of the formula $M_xFe_{3-x}O_4$ wherein M is Mg, Mn, Fe, Co, Ni, Cu, Zn, Cd or the like, a hexagonal ferrite such as $BaO.6Fe_2O_3$ or $SrO.6Fe_2O_3$, a garnet oxide such as $Y_3Fe_5O_{12}$ or $Sm_3Fe_5O_{12}$, a rutile oxide such as $CrO_2$, or one showing magnetism at a temperature in the vicinity of from 0° C. to 60° C. among metals such as Cr, Mn, Fe, Co and Ni, and their ferromagnetic alloys. Among them, magnetite, maghematite or an intermediate of magnetite and maghematite is preferred. In a case where such a magnetic colorant is added with a view to preventing scattering or controlling the electrostatic property, while the characteristics as a non-magnetic toner are maintained, its amount is from 0.5 to 10 parts by weight, preferably from 0.5 to 8 parts by weight, more preferably from 1 to 5 parts by weight, per 100 parts by weight of the above binder resin. Further, in a case where the toner is used as a magnetic toner, its amount is preferably at least 20 parts by weight and at most 150 parts by weight, per 100 parts by weight of the above binder resin.

The present invention is characterized in that the particles constituting the toner contain a fixing aid having a melting point of from 30 to 100° C. and a surface tension of at least 39 mN/m. As the toner particles contain a fixing aid having such characteristics, the low temperature fixing property will be improved, the high temperature offset will be suppressed, and at the same time, the toner melted or softened during the fixing will be firmly bonded to the fixing substrate such as paper.

The fixing aid in the present invention has a melting point of at least 30° C., preferably at least 40° C. and at most 100° C., preferably at most 80° C., more preferably at most 70° C. If the melting point exceeds this range, the low temperature fixing property will deteriorate, and if it is less than the above range, the fixing aid tends to bleed out from the toner, whereby the storage stability tends to deteriorate. Here, the melting point of the fixing aid is measured by raising the temperature at a rate of 10° C./min in a nitrogen stream by means of DSC in accordance with JIS K7121. The peak temperature at the fusion peak in a graph prepared by plotting the temperature on the abscissa and the caloric value on the ordinate, is taken as the melting point. Further, the melting point of the fixing aid may be measured by using the toner. However, there may be a case where the content in the toner is too small, or it can hardly be distinguished from the melting point of another component. Accordingly, it is common to use a value obtained by measuring only the compound to be used as the fixing aid.

The fixing aid in the present invention has a surface tension of at least 39 mN/m, preferably at least 42 mN/m, more preferably at least 44 mN/m, particularly preferably at least 45 mN/m. If the surface tension is within the above range, the bonding force of the toner melted or softened during the fixing to a fixing substrate such as paper, is strong, and offset on the fixing roller will be prevented. The upper limit of the surface tension of the fixing aid is not particularly limited, but it is usually at most 55 mN/m, preferably at most 50 mN/m. Here, the method for measuring the surface tension is not particularly limited, and it may suitably selected for use depending upon the nature of the fixing aid among common measuring methods such as a Whilhelmi method (a plate method), a pendant drop method, a bubble pressure method or a contact angle method. Further, the surface tension of such a fixing aid usually means a value measured by using only the compound used as the fixing aid.

For the toner for developing an electrostatic charge image of the present invention, it is not sufficient to simply incorporate a fixing aid having the specific melting point and surface tension into the toner, and it is important to have such a fixing aid dispersed with a certain specific particle diameter in the toner particles. Namely, the average dispersed particle diameter of the fixing aid in the toner particles is at most 1 μm, preferably at most 0.5 μm, more preferably at most 0.3 μm, particularly preferably at most 0.2 μm. If the average particle diameter of the fixing aid exceeds the above range, the low temperature fixing property tends to deteriorate, and further, with a color toner, the transparency tends to be low, such being undesirable. As the average particle diameter of the fixing aid becomes smaller, the melt viscosity of the toner tends to be low, and it tends to be possible to obtain a good low temperature fixing property even if the content of the fixing aid is small. Further, even in a case where the fixing aid is incorporated in a large amount in the toner, if the dispersed particle diameter of the fixing aid is small, it is possible to prevent leaching out of the toner. Further, if the fixing aid is finely dispersed in the toner, at the time of heating to fix the toner on a fixing substrate, melting of the fixing aid takes place immediately, whereby a good fixing reinforcing effect and anti-offset property can be obtained. Here, the measurement of the average dispersed particle diameter of the fixing aid in the toner particles, is meant for an average particle diameter on the basis of the number of particles when the toner is observed by a transmission electron microscope (TEM) and is usually an average value of the measurements of at least 1,000 particles. Further, in the measurement of the dispersed particle diameter of the fixing aid, in a case where it is difficult to distinguish the fixing aid from another component such as the after-mentioned particles of wax co-present, the measurement may be carried out by preliminarily preparing a toner not containing such another component.

The lower limit of the average dispersed particle diameter of the fixing aid in the toner particles is not particularly limited, and it may be finely dispersed to such an extent that the particle diameter can not be ascertained. However, if the fixing aid is soluble in the binder resin, there may be a case where the glass transition temperature of the toner particles tends to be low, and the heat resistance tends to deteriorate, or there may be a case where the low temperature fixing property tends to deteriorate. Further, the melt viscosity of the toner tends to be low, whereby depending upon the conditions set for the fixing apparatus, there may be a case where a fixing offset phenomenon will result. Therefore, the average dispersed particle diameter of the fixing aid in the toner particles is preferably at least 0.01 μm, more preferably at least 0.05 μm.

As a method to bring the average dispersed particle diameter of the fixing aid within the above range, a method of optimizing the molecular structure, the molecular weight and the molecular-weight distribution of the fixing aid to be used, or a method of optimizing the production method of the toner, may be mentioned. In a case where the affinity of the fixing aid and the binder resin is high such that the solubility parameters of the fixing aid and the binder resin are close to each other, the fixing aid tends to be finely dispersed. As a method for producing the toner, a wet method represented by a polymerization method is capable of finely dispersing the fixing aid rather than a melt-kneading pulverization method. Among the polymerization methods, it is preferred to employ an emulsion polymerization flocculation method, whereby the dispersed particle diameter of the fixing aid in the toner can be made fine. It is particularly preferred to employ a method wherein a binder resin is emulsion polymerized by using the fixing aid as seeds.

In the present invention, the fixing aid has a fusion peak with a half value width of preferably at most 10° C., more preferably at most 9° C., further preferably at most 8.5° C. If the half value width of the fusion peak exceeds the above range, the fixing aid will not quickly be melted at the time of fixing, and no adequate fixing reinforcing effect may sometimes be obtainable. The lower limit of the half value width of the fusion peak is not particularly limited, but it is usually at least 2° C., preferably at least 5° C. Here, the measurement of the half value width of the fusion peak of the fixing aid, is carried out in the same manner as the method for measuring the melting point of the fixing aid as described above. The half value width means a peak width (° C.) at a position which is one half of the height of the fusion peak.

Further, the fixing aid in the present invention preferably has a heat of fusion of preferably at least 80 J/g, more preferably at least 90 J/g. The heat of fusion being high means that a large thermal energy is required to melt it during the fixing. However, the thermal energy to soften the binder resin is usually sufficient for melting the fixing aid. On the other hand, if the heat of fusion is less than the above range, the fixing aid is likely to be melted during the storage of the toner or during the waiting period in a cartridge, whereby the toner may undergo blocking. Otherwise, the fixing aid may be melted at a stage before the toner is transferred to the fixing step via a developing step, whereby soiling of the apparatus may result. The upper limit of the heat of fusion is not particularly limited, but it is usually at most 250 J/g, preferably at most 150 J/g. Here, the measurement of the heat of fusion of the fixing aid is carried out in the same manner as the method for measuring the melting point of the fixing aid, and the heat of fusion means a value calculated from the area of the fusion peak.

The fixing aid in the present invention preferably has a crystallization peak with a half value width of at most 12° C., more preferably at most 10° C., further preferably at most 8° C., particularly preferably at most 7° C. When the half value width of the crystallization peak is within the above range, the fixing aid melted during the fixing will be quickly solidified, whereby no filming on the fixing roller will be caused, and the high temperature offset property tends to be good. The lower limit for the half value width of the crystallization peak is not particularly limited, but it is usually at least 1° C., preferably at least 2° C. Here, the measurement of the half value width of the crystallization peak of the fixing aid is made by a temperature lowering (cooling) measurement at a rate of 10° C./min in the same manner as the above-mentioned method for measuring the melting point of the fixing aid, and the half value width means a peak width (° C.) at a position which is one half of the height of the peak.

The fixing aid in the present invention preferably has a number average molecular weight of preferably at least 500, more preferably at least 1,000, further preferably at least 2,000 and preferably at most 60,000, more preferably at most 30,000, further preferably at most 10,000. In a case where the number average molecular weight of the fixing aid exceeds the above range, the low temperature fixing property of the toner may sometimes be impaired, and if it is less than the above range, the fixing aid tends to bleed out (leak out) from the toner, thus leading to e.g. filming on a photoreceptor. Here, the number average molecular weight is a value calculated as polystyrene by means of gel permeation chromatography (GPC).

The content of the fixing aid is usually at least 0.1 part by weight, preferably at least 1 part by weight, more preferably at least 3 parts by weight and usually at most 40 parts by weight, preferably at most 15 parts by weight, more preferably at most 10 parts by weight, per 100 parts by weight of the toner. If the content of the fixing aid in the toner exceeds the above range, the amount of the fixing aid exposed at the toner surface tends to be large, whereby the electrostatic property or durability may sometimes deteriorate, and if it is less than the above range, no adequate low temperature fixing property may sometimes be obtainable.

Further, the content of the fixing aid is usually at least 0.1 part by weight, preferably at least 1 part by weight, more preferably at least 3 parts by weight and usually at most 40 parts by weight, preferably at most 15 parts by weight, more preferably at most 10 parts by weight, per 100 parts by weight of the binder resin. If the content of the fixing aid in the binder resin exceeds the above range, the amount of the fixing aid exposed at the toner surface tends to be large, whereby the electrostatic property or durability may sometimes deteriorate, and if it is less than the above range, no adequate low temperature fixing property may sometimes be obtainable. Further, in a case where the fixing aid to be used in the present invention is employed substantially as a binder resin, the melt viscosity at the time of thermal fixing tends to be too low to carry out fixing satisfactorily.

With respect to the fixing aid in the present invention, its chemical structure is not particularly limited so long as it is one showing the above-described characteristics. Compounds having the above-mentioned surface tension, melting point and other characteristics are not many. Among them, a compound having hydroxyl groups in its molecule is more preferred. Further preferably, it is a polyester constituted mainly by a aliphatic chain. Particularly preferably, it is most preferred that it is a polylactone.

A method to ascertain that the fixing aid in the present invention is contained in the toner for developing an electrostatic charge image thus produced, is not particularly limited. It is possible to directly measure the toner by various methods. For example, it is possible to employ a method wherein the cross section of the toner is exposed by means of e.g. an ultramicrotome, followed by ascertaining by means of various microspectrometric methods, or a method wherein the fixing aid is separated from the binder resin and other components by utilizing the difference in solubility in a solvent, followed by ascertaining.

Now, the polylactone which may be used suitably as a fixing aid in the present invention, will be described in detail.

The polylactone to be used as the fixing aid is mainly a polymer obtained by ring opening polymerization of a lactone. The lactone monomer is not particularly limited, and it may, for example, be a β-lactone such as β-propiolactone or dimethylpropiolactone, a γ-lactone such as butyrolactone, γ-valerolactone, γ-caprolactone, γ-caprylolactone, γ-laurolactone, γ-palmitolactone, γ-stearolactone, crotolactone, α-angelica lactone or β-angelica lactone, a δ-lactone such as δ-valerolactone, δ-caprolactone or cumarin, an ϵ-lactone such as ϵ-caprolactone, ϵ-caprylolactone, ϵ-laurolactone or ϵ-palmitolactone, or a large cyclic lactone having a 8 to 16 membered ring. Among them, γ-butyrolactone, δ-valerolactone or ϵ-caprolactone is preferably employed, and ϵ-caprolactone is particularly preferred. As a polylactone obtainable by ring opening of a lactone may, for example, be PLACCEL (trademark) 200 series (polycaprolactonediol), 300 series (polycaprolactonetriol), manufactured by Daicel Chemical Industries, Ltd., or H1P.

Further, the polylactone in the present invention may be a homopolymer made of a single lactone as the raw material or a copolymer made of a plurality of lactones as the raw materials. In the case where the polylactone is made of a plurality of lactones as the starting materials, the composition is not particularly limited. However, usually, it is preferred that the same lactone is at least 50 wt %, preferably at least 70 wt %, more preferably at least 90 wt %. From the viewpoint of the crystallinity of the polylactone, the polylactone is preferably one made substantially of a single lactone as the raw material. Further, it may be a copolymer containing a component other than a lactone as the copolymer component, so long as the effects of the present invention are not impaired. In a case where a copolymer component other than lactone is contained, the content is not particularly limited, but is usually at most 50 wt %, preferably at most 30 wt %, more preferably at most 10 wt %. From the viewpoint of the crystallinity of the polylactone, it is preferred that substantially no component other than a lactone is contained.

Further, it is also possible to use in the present invention a polymer having at least a part of terminals of the polylactone modified or a polymer having another ester-forming component introduced into the polylactone skeleton by e.g. an ester exchange reaction after the polymerization.

Further, the polylactone to be used in the present invention is not limited to one obtainable by a ring opening polymerization reaction of a lactone, so long as it is a polymer having substantially the same chemical structure as described above, and includes one by other polymerization reaction. Further, it may be one obtained by a biological method, such as production from bacteria, or one taken, extracted, purified or modified from a natural product.

The toner for developing an electrostatic charge image of the present invention can be made to be a toner excellent in the low temperature fixing property and fixing strength by incorporating the polylactone into the toner particles. Namely, when a non-fixed toner having e.g. an electrostatic latent image developed, is heated for fixing by e.g. a fixing roller, the polylactone dispersed in the toner will be melted at a relatively low temperature and will appear on the toner surface in a proper degree. The polylactone leached out at the toner surface during the heating for fixing will hinder fusion of the toner to the fixing roller, but it is rare that after the fixing, the polylactone will remain on the surface of the fixing roller. Besides, after cooling for solidification, the polylactone at the surface of the toner will be firmly bonded to a fixing substrate such as a paper or OHP sheet, whereby the fixing strength is considered to become high. Especially when a polylactone is used as the fixing aid, hydroxyl groups present in the polylactone molecule have good affinity to the fixing substrate such as paper, whereby there will be an effect such that the fixing strength will be improved.

In the toner for developing an electrostatic charge image of the present invention, the polylactone may not simply be incorporated to the toner, but it is important to have the polylactone dispersed with a specific particle diameter in the toner particles. Namely, the average dispersed particle diameter of the polylactone in the toner particles is at most 1 μm, preferably at most 0.5 μm, more preferably at most 0.3 μm, particularly preferably at most 0.2 μm. If the dispersed particle diameter of the polylactone exceeds the above range, the low temperature fixing property tends to deteriorate, and further, with a color toner, the transparency tends to be low, such being undesirable. The smaller the dispersed particle diameter of the polylactone, the lower the melt viscosity of the toner tends, and even if the content of the polylactone is small, a good low temperature fixing property tends to be obtainable. Further, even in a case where the polylactone is incorporated in a large amount to the toner, if the dispersed particle diameter of the polylactone is small, it is possible to prevent the polylactone from leaching out from the toner. Further, if the polylactone is finely dispersed in the toner, when the toner on a fixing substrate is heated for fixing, melting of the polylactone takes place immediately, whereby a good anti-offset property can be obtained. Here, the measurement of the average dispersed particle diameter of the polylactone in the toner particles means the average particle diameter on the basis of the number of particles as observed by a transmission electron microscope (TEM) and is usually an average value when at least one hundred particles are measured. Further, in the measurement of the dispersed particle diameter of the polylactone, in a case where it is difficult to distinguish the polylactone, since another component such as the after-mentioned particles of wax is co-present, the measurement may be made by preliminarily preparing a toner not containing such another component.

The lower limit of the average dispersed particle diameter of the polylactone in the toner particles is not particularly limited, and it may be finely dispersed to such an extent that the particle diameter can not be ascertained. However, if the polylactone is soluble in the binder resin, there may be a case where the glass transition temperature of the toner particles tends to be low, and the heat resistance tends to deteriorate, or a case where the low temperature fixing property tends to deteriorate. Further, as the melt viscosity of the toner tends to be low, there may be a case where the fixing offset phenomenon will result depending upon the conditions set for the fixing apparatus. Therefore, the average dispersed particle diameter of the polylactone in the toner particles is preferably at least 0.01 μm, more preferably at least 0.05 μm.

A method to bring the average dispersed particle diameter of the polylactone within the above range, may, for example, be a method of optimizing the molecular structure, the molecular weight and the molecular weight distribution of the polylactone to be used, or a method of optimizing the method for producing the toner. In a case where the affinity between the polylactone and the binder resin is high such that the solubility parameters of the polylactone and the binder resin are close to each other, the polylactone tends to be finely dispersed.

As the method for producing the toner, rather than the melt-kneading pulverization method, a wet method represented by the polymerization method, is preferred, since the polylactone can be thereby finely dispersed. Among polymerization methods, an emulsion polymerization flocculation method is preferred since it is thereby possible to make the dispersed particle diameter of the polylactone in the toner to be fine. It is particularly preferred to employ a method wherein by using the polylactone as seeds, the binder resin is emulsion-polymerized. Further, in the measurement of the dispersed particle diameter of the polylactone, in a case where it is difficult to distinguish the polylactone particles, since the after-mentioned particles of wax, etc. are co-present as dispersed, the measurement may be carried out by preliminarily preparing a toner not containing such wax particles, etc.

The number average molecular weight of the polylactone to be used in the present invention is usually at least 500, preferably at least 1,000, more preferably at least 2,000 and usually at most 60,000, preferably at most 30,000, more preferably at most 10,000. If the number average molecular weight of the polylactone exceeds the above range, the low temperature fixing property of the toner may sometimes be impaired, and if it is less than the above range, the polylactone tends to bleed out (leak out) from the toner and may cause e.g. filming on a photoreceptor. Here, the number average molecular weight is a value calculated as polystyrene by means of gel permeation chromatography (GPC).

The polylactone in the present invention is suitably one which is solid at room temperature. Further, the polylactone in the present invention has crystallinity. If the polylactone has no crystallinity, the polylactone in the toner will not sharply melt, whereby the fixing property tends to be inadequate, and the polylactone tends to bleed out (leak out), whereby the storage stability tends to be low. It is possible to ascertain whether or not the polylactone has crystallinity, by ascertaining the presence of a crystal fusion peak by DSC.

The melting point of the polylactone is usually at least 30° C., preferably at least 40° C. and usually at most 100° C., preferably at most 80° C., more preferably at most 70° C. If the melting point exceeds the above range, the low temperature fixing property tends to deteriorate, and if it is less than the above range, the fixing aid tends to bleed out from the toner, whereby the storage stability tends to be low. Here, the melting point of the polylactone is measured by raising the temperature at a rate of 10° C./min in a nitrogen stream by means of DSC in accordance with JIS K7121. The peak temperature of the fusion peak in a graph having the temperature plotted on the abscissa and the heat balance plotted on the ordinate, is taken as the melting point. Further, the melting point of the polylactone may be measured by using the toner. However, in a case where the content of the toner is small or in a case where it is difficult to distinguish the melting point from the melting point of another component, usually a value obtained by measuring only the polylactone to be used, may be applied.

The content of the polylactone is usually at least 0.1 part weight, preferably at least 1 part by weight, more preferably at least 3 parts by weight and usually at most 40 parts by weight, preferably at most 15 parts by weight, more preferably at most 10 parts by weight, per 100 parts by weight of the toner. If the content of the polylactone in the toner exceeds the above range, the amount of the polylactone exposed at the toner surface will be large, whereby the electrostatic property or durability may sometimes deteriorate, and if it is less than the above range, no adequate low temperature fixing property may sometimes be obtainable.

Further, the content of the polylactone is usually at least 0.1 part by weight, preferably at least 1 part by weight, more preferably at least 3 parts by weight and usually at most 40 parts by weight, preferably at most 15 parts by weight, more preferably at most 10 parts by weight, per 100 parts by weight of the binder resin. If the content of the polylactone to the binder resin exceeds the above range, the amount of the polylactone exposed at the toner surface tends to be large, whereby the electrostatic property or durability may sometimes deteriorate, and if it is less than the above range, no adequate low temperature fixing property may sometimes be obtainable. Further, if the polylactone to be used in the present invention is used substantially as the binder resin, the melt viscosity during the thermal fixing tends to be too low to carry out the fixing satisfactorily.

In the toner for developing-an electrostatic charge image of the present invention, wax not corresponding to the fixing aid may be used in combination with the fixing aid. In the present invention, by incorporating the fixing aid to the toner particles, a good low temperature fixing property can be obtained. By using wax in combination, there may be a case where generation of high temperature offset can be further suppressed or a case where the anti-filming property can be further improved.

The wax which may be used in the present invention is not particularly limited so long as it is commonly used for toners and is not one included in the above fixing aid. Specifically, it may, for example, be an olefin wax such as a low molecular weight polyethylene, a low molecular weight polypropylene or a copolymer polyethylene; a paraffin wax; a silicone wax; a higher fatty acid such as stearic acid; a long chain aliphatic alcohol such as eicosanol; an ester wax having a long chain aliphatic group, such as behenyl behenate, a montanic acid ester or stearyl stearate; a ketone having a long chain alkyl group, such as disstearyl ketone; a plant wax such as hydrogenated castor oil or carnauba wax; an ester or partial ester obtained from a long chain fatty acid and a polyhydric alcohol such as glycerol or pentaerythritol; a higher fatty acid amide such as an oleic acid amide or stearic acid amide; or a low molecular weight polyester other than a polylactone.

If the above wax is incorporated in a large amount, it tends to be exposed at the surface of the toner, whereby the electrostatic property or heat resistance of the toner may sometimes be impaired. Therefore, it is preferred to select one which is effective in a small amount. As a wax suitable for the present invention, it is advisable to select it from a paraffin wax; an olefin wax such as low molecular weight polyethylene or a copolymer polyethylene; an ester wax; and a silicone wax. Particularly preferred is a silicone wax.

The above wax preferably has at least one absorption peak by DSC within a range of from 50 to 100° C.

Further, the wax preferably has a surface tension of preferably at most 35 mN/m, more preferably at most 30 mN/m, further preferably at most 28 mN/m and preferably at least 20 mN/m, more preferably at least 24 mN/m.

The content of the wax is preferably at least 0.05 part by weight, more preferably at least 0.1 part by weight and at most 20 parts by weight, more preferably at most 15 parts by weight, per 100 parts by weight of the toner.

Further, the total of the contents of the fixing aid and the wax is preferably at least 0.15 part by weight, more preferably at least 1 part by weight and preferably at most 40 parts by weight, more preferably at most 30 parts by weight, particularly preferably at most 20 parts by weight, per 100 parts by weight of the toner.

Further, the ratio (weight ratio) of the contents of the fixing aid and the wax in the toner is such that the fixing aid:wax is from 30:1 to 1:10, more preferably from 20:1 to 1:5, further preferably from 10:1 to 1:3. If the ratio of the contents of the fixing aid and the wax is within the above range, the fixing temperature range will be wide, and the anti-filming property tends to be good.

The dispersed particle diameter of the toner particles in the above wax is such that the average particle diameter is usually at least 0.1 μm, preferably at least 0.3 μm and usually at most 3 μm, preferably at most 1 μm. If the average particle diameter is less than the above range, the effect for improving the anti-filming property of the toner may sometimes be inadequate, and if it exceeds the above range, the wax is likely to be exposed at the toner surface, whereby the antistatic property or heat resistance may sometimes deteriorate. Here, the dispersed particle size of the wax may be determined not only by a method wherein the toner is formed into a thin film and observed by an electron microscope but also by a method wherein the binder resin of the toner is eluted by e.g. an organic solvent which does not dissolve the wax, followed by-filtration through a filter, and the wax particles remaining on the filter are measured by a microscope. In a case where the dispersed particle diameter of the wax can not be determined due to the presence of another component such as the fixing aid, the particle diameter can be determined by preparing a toner containing no such another component in the same manner as the toner of the present invention.

To the toner for developing an electrostatic charge image of the present invention, an electrification-controlling agent may be added in order to adjust the electrostatic charge and to impart the electrostatic stability. Such an electrification-controlling agent is not particularly limited so long as it is a known compound which has been used for toners. For example, a positively chargeable electrification-controlling agent may, for example, be a nigrosine dye, a quaternary ammonium salt, a triaminotriphenylmethane compound, an imidazole compound or a polyamine resin. A negatively chargeable electrification-controlling agent may, for example, be an azo complex compound dye containing an atom such as Cr, Co, Al, Fe or B, an alkyl salicylic acid complex compound or a calix (n) arene compound. When it is used for a color toner for a full color toner, it is necessary to chose the color of the electrification-controlling agent to be colorless or pale color in order to avoid a coloring trouble. For this purpose, the positively chargeable electrification-controlling agent is preferably a quaternary ammonium salt or an imidazole compound, and the negatively chargeable electrification-controlling agent is preferably an alkyl salicylic acid complex compound containing an atom such as Cr, Co, Al, Fe or B or a calix (n) arene compound, among those mentioned above. Otherwise, it may be a mixture thereof. The amount of the electrification-controlling agent is preferably within a range of from 0.1 to 5 parts by weight per 100 parts by weight of the binder resin.

Now, the method for producing a toner for developing an electrostatic charge image of the present invention will be described in detail.

The method for producing a toner for developing an electrostatic charge image of the present invention may be a conventional melt kneading pulverization method or a wet system method represented by a polymerization method. From the viewpoint of the dispersibility of the fixing aid, it is preferred to produce the toner by a wet method.

In the case of the melt kneading pulverization method, the kneading for dispersion of the binder resin and the fixing aid is carried out usually by means of a kneader or an extruder. However, by dispersion by shearing, dispersion to a particle diameter of about 1 μm is the limit, and it is usually difficult to further reduce the particle diameter. Further, in a case where the fixing aid undergoes a chemical reaction with the binder resin or has a particularly high compatibility, it will receive shearing in a molten state and may thereby be mixed at a molecular level, whereby the effect for improving the low temperature fixing property as the fixing aid may not sometimes be obtainable. Whereas, in the wet system method, a wet system dispersing machine is used, whereby it is easily possible to reduce the particle diameter to a submicron level, such being desirable.

As a method to obtain a toner by a wet system method, a method by means of a polymerization method such as a suspension polymerization method or an emulsion polymerization flocculation method, or a chemical pulverization method may, for example, be suitably used. Any one of such methods may be used as a method for producing the toner containing the fixing aid of the present invention. However, it is more referred to produce it by an emulsion polymerization flocculation method. By the emulsion polymerization flocculation method, by using the fixing aid preliminarily as dispersed, it is possible to disperse it with a small particle diameter constantly. In the emulsion polymerization flocculation method, the particle diameter of the fixing aid preliminarily dispersed, can be maintained to the end of the production step. Whereas, in the suspension polymerization or chemical pulverization method, a monomer or a solvent is used during the production process, whereby the fixing aid is likely to agglomerate to have a large particle diameter.

Now, the toner of the present invention to be produced by the emulsion polymerization flocculation method as a preferred embodiment, will be described in further detail. In the production method which will be described hereinafter, a polylactone is used as an example of the fixing aid, but it should be understood that the fixing aid is not limited to the polylactone.

In the present invention, the emulsion polymerization flocculation method means a method for producing a toner comprising an emulsion polymerization step and a flocculation step and usually has a polymerization step, a mixing step, a flocculation step, an aging step and a washing and drying step. Namely, usually, (a) to a dispersion containing primary particles of the polymer obtained by an emulsion polymerization, a colorant and, if necessary, an electrification-controlling agent, wax, etc., are mixed, (b) the primary particles in this dispersion are flocculated to form particle agglomerates, (c) if necessary, other particles, etc. are deposited, followed by fusing, and (d) the obtained particles are washed and dried to obtain toner particles.

A method to introduce the polylactone to the toner by the emulsion polymerization flocculation method is not particularly limited so long as it is a method wherein the polylactone is incorporated to the toner particles. Such a polylactone may be used as a constituting component independent from the binder resin in the process for producing the toner. However, it is preferred to use it as dispersed in the binder resin from the viewpoint of preventing agglomeration of the polylactone and the production stability of the toner. For this purpose, a method of adding it during the polymerization is preferred, and specifically, the following methods may be mentioned.

(1) A method wherein a polymerizable monomer and a polylactone are mixed; the polylactone is finely dispersed in the monomer by a mechanical dispersing means, if necessary under heating; and then the monomer is emulsion-polymerized to obtain a dispersion containing primary particles of the polymer.

(2) A method wherein a dispersion obtained by dispersing a polylactone in a medium by a mechanical dispersing means if necessary under heating, is used as seeds, and a polymerizable monomer is dropwise added thereto to carry out emulsion polymerization to obtain primary particles of the polymer internally containing the polylactone.

Among them, the method (2) i.e. the method of carrying out emulsion polymerization using the polylactone as seeds, is particularly preferred.

In a case where the polylactone is dispersed in a monomer or water, it is preferred to adjust so that the volume average particle diameter of the polylactone particles dispersed will be from 0.01 to 0.5 μm, preferably from 0.05 to 0.3 μm. In a case where the polylactone is dispersed in the monomer, the polylactone may be added to the monomer, followed by stirring by using a mechanical means, if necessary under heating and/or under pressure. Further, in a case where the polylactone is dispersed in water, a method is employed wherein the polylactone heated to a temperature of at least the melting point of the polylactone, i.e. usually at a temperature of at least 80° C., preferably from 80 to 90° C., and hot water are treated under a high shearing force by means of e.g. a homogenizer in the presence of an emulsifying agent. This treatment may be carried out under pressure. Here, as the emulsifying agent, one similar to the after-mentioned emulsifier to be used for emulsion polymerization of a binder resin, may be used, and it is preferred to use the same one. It is preferred to preliminarily control the particle diameter of the polylactone dispersed in a liquid at the time of the preparation of such an emulsion polymerized agglomerated toner, it is thereby easy to finally control the dispersed particle diameter of the polylactone in the toner. Here, other methods may be employed to obtain the above-mentioned volume average particle diameter. As the binder resin constituting the primary particles of a polymer to be used for the emulsion polymerization flocculation method, the above-mentioned resin may be employed. However, as the polymerizable monomer, it is preferred to use a monomer having a Brønsted acidic group (hereinafter sometimes referred to simply as an acidic monomer) and/or a monomer having a Brønsted basic group (hereinafter sometimes referred to simply as a basic monomer), and a monomer having neither Brønsted acidic group nor Brønsted basic group (hereinafter sometimes referred to simply as other monomer), as the starting material monomers. At that time, the respective monomers may be added separately, or a plurality of monomers may be preliminarily mixed and simultaneously added. Further, it is possible that during the addition of the monomers, the monomer composition may be changed. Further, the monomers may be added as they are, or they may be added in the form of an emulsion preliminarily mixed and adjusted with water, an emulsifying agent, etc.

The acidic monomer may, for example, be a monomer having a carboxyl group such as acrylic acid, methacrylic acid, maleic acid, fumaric acid or cinnamic acid, a monomer having sulfonate group such as styrene sulfonate, or a monomer having a sulfonamide group such as vinylbenzene sulfonamide. Whereas, the basic monomer may, for example, be an aromatic vinyl compound having an amino group, such as amino styrene, a monomer containing a nitrogen-containing heterocyclic ring such as vinylpyridine or vinylpyrrolidone, or a (meth)acrylate having an amino group such as dimethylamino ethyl acrylate or diethylamino ethyl methacrylate.

These acidic monomers and basic monomers may be used alone or in combination as a mixture of a plurality of them, or they may be present in the form of a salt accompanying a counter ion. Among them, it is preferred to employ an acidic monomer. More preferably acrylic acid and/or methacrylic acid is employed. The total amount of acidic monomers and basic monomers in the entire monomers constituting the binder resin as primary particles of the monomer, is preferably at least 0.05 wt %, more preferably at least 0.5 wt %, further preferably at least 1 wt % and preferably at most 10 wt %, more preferably at most 5 wt %.

Other monomers may, for example, be a styrene such as styrene, methylstyrene, chlorostyrene, dichlorostyrene, p-tert-butylstyrene, p-n-butylstyrene or p-n-nonylstyrene, an acrylate such as methyl acrylate, ethyl acrylate, propyl acrylate, n-butyl acrylate, isobutyl acrylate, hydroxyethyl acrylate or ethylhexyl acrylate, a methacrylate such as methyl methacrylate, ethyl methacrylate, propyl methacrylate, n-butyl methacrylate, isobutyl methacrylate, hydroxyethyl methacrylate or ethylhexyl methacrylate, acrylamide, N-propylacrylamide, N,N-dimethylacrylamide, N,N-dipropylacrylamide, N,N-dibutylacrylamide or acrylic acid amide. Such monomers may be used alone or in combination as a mixture of a plurality of them.

In the present invention, the above monomers, etc. are preferably employed in combination. As a preferred embodiment, an acidic monomer and other monomers may be used in combination. More preferably, it is preferred to use acrylic acid and/or methacrylic acid as an acidic monomer and a monomer selected from styrenes, acrylates and methacrylates, as other monomers. Further preferably, it is preferred to combine acrylic acid and/or methacrylic acid as an acidic monomer with styrene and an acrylate and/or a methacrylate, as other monomers. Particularly preferably, it is preferred to combine acrylic acid and/or methacrylic acid with styrene and n-butyl acrylate.

Further, in a case where a crosslinked resin is used as the binder resin constituting the primary particles of the polymer, a radical polymerizable polyfunctional monomer is employed as a crosslinking agent to be used in combination with the above-described monomer. It may, for example, be divinyl benzene, hexane diol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate. Further, it is also possible to use a monomer having a reactive group as a pendant group, such as glycidyl methacrylate, methylol acrylamide or acrolein. Among them, a radical polymerizable bifunctional monomer is preferred, and divinylbenzene or hexanedioldiacrylate is particularly preferred.

These polyfunctional monomers may be used alone or in combination as a mixture of a plurality of them. In a case where a crosslinked resin is employed as the binder resin constituting the primary particles of the polymer, the blend ratio of the polyfunctional monomer in the entire monomers constituting the resin, is preferably at least 0.05 wt %, more preferably at least 0.1 wt %, further preferably at least 0.3 wt % and preferably at most 5 wt %, more preferably at most 3 wt %, further preferably at most 1 wt %.

As the emulsifying agent to be used for emulsion polymerization, a known product may be employed. However, one or more emulsifying agents selected from cationic surfactants, anionic surfactants and nonionic surfactants may be used.

The cationic surfactants may, for example, be dodecylammonium chloride, dodecylammonium bromide, dodecyltrimethylammonium bromide, dodecylpyridinium chloride, dodecylpyridinium bromide and hexadecyltrimethylammonium bromide; the anionic surfactants may, for example, be a fatty acid soap such as sodium stearate or sodium dodecanoate, sodium dodecyl sulfate, sodium dodecylbenzene sulfonate, and sodium lauryl sulfate; and the nonionic surfactants may, for example, be polyoxyethylene dodecyl ether, polyoxyethylene hexadecyl ether, polyoxyethylene nonyl phenyl ether, polyoxyethylene lauryl ether, polyoxyethylene sorbitan monooleate ether and monodecanoylsucrose.

The amount of the emulsifying agent is usually from 1 to 10 parts by weight per 100 parts by weight of the polymerizable monomer. Further, to such an emulsifying agent, one or more of polyvinyl alcohols such as partially or completely saponified polyvinyl alcohols, or cellulose derivatives such as hydroxyethyl cellulose, may be used in combination as a protective colloid.

As a polymerization initiator, one or more of hydrogen peroxide; persulfates such as potassium persulfate; organic peroxides such as benzoyl peroxide and lauroyl peroxide; azo compounds such as 2,2'-azobisisobutylonitrile and 2,2'-azobis(2,4-dimethylvaleronitrile); and redox type initiators, may be used usually in an amount of from 0.1 to 3 parts by weight per 100 parts by weight of the polymerizable monomers. It is particularly preferred that as the initiator, at least a part or whole is hydrogen peroxide or an organic peroxide.

Further, one or more suspension stabilizers such as potassium phosphate, magnesium phosphate, calcium hydroxide and magnesium hydroxide, may be employed usually in an amount of from 1 to 10 parts by weight per 100 parts by weight of the polymerizable monomers.

The polymerization initiator and the suspension stabilizer may, respectively, be added to the polymerization system at any time i.e. before, at the same time as or after the addition of monomers, and if necessary, these methods for addition may be used in combination.

At the time of emulsion polymerization, a known chain transfer agent may be used as the case requires. Specific examples of such a chain transfer agent include t-dodecyl mercaptan, 2-mercaptoethanol, diisopropyl xanthogen, carbon tetrachloride and trichlorobromomethane. Such chain transfer agents may be used alone or in combination as a mixture of two or more of them. The chain transfer agent is employed usually within a range of at most 5 wt %, based on the entire monomers. Further, to the reaction system, a pH-controlling agent, a polymerization degree-adjusting agent, a defoaming agent, etc. may further be added as the case requires.

In the emulsion polymerization, the above monomers are polymerized in the presence of the polymerization initiator. The polymerization temperature is usually from 50 to 120° C., preferably from 60 to 100° C., further preferably from 70 to 90° C.

The volume average particle diameter of the primary particles of the polymer obtained by the emulsion polymerization is usually at least 0.02 μm, preferably at least 0.05 μm, further preferably at least 0.1 μm and usually at most 3 μm, preferably at most 2 μm, further preferably at most 1 μm. If the particle diameter is less than the above range, there may be a case where control of the flocculation rate tends to be difficult, and if it exceeds the above range, the particle diameter of the toner obtained by flocculation tends to be too large, and there may be a case where it is difficult to obtain a toner having the desired particle diameter.

Tg by the DSC method of the binder resin constituting the primary particles of the polymer in the present invention, is preferably from 40 to 80° C. Here, in a case where Tg of the binder resin can not be clearly judged as it overlaps the heat change based on another component, such as the fusion peak of the polylactone or wax, it means Tg when the toner is prepared in a state where such another component is omitted.

In the present invention, the acid value of the binder resin constituting the primary particles of the polymer is preferably from 3 to 50 mgKOH/g, more preferably from 5 to 30 mgKOH/g, as a value measured by a method in accordance with JIS K0070.

As a method for incorporating a colorant in the emulsion polymerization flocculation method, usually, a dispersion of the primary particles of the polymer and a dispersion of the particles of the colorant are mixed to obtain a mixed dispersion, which is flocculated to obtain agglomerates of particles. The colorant is preferably employed in such a state as emulsified in water in the presence of an emulsifying agent, and the volume average particle diameter of the colorant particles is preferably from 0.01 to 3 μm.

As a method of incorporating wax in the emulsion polymerization flocculation method, it is preferred that an emulsion of wax preliminarily emulsified and dispersed in water in a volume average diameter of from 0.01 to 2.0 μm, more preferably from 0.01 to 0.5 μm, is added during the emulsion polymerization in the same manner as the polylactone, or added in the flocculation step. In order to disperse wax in a preferred dispersed particle diameter in the toner, it is preferred that wax is added as seeds during the emulsion polymerization. By adding wax as seeds, wax will not be present in a large amount at the toner surface, whereby deterioration of the electrostatic property or heat resistance of the toner can be prevented. In such a case, the wax dispersion and the polylactone dispersion may be co-present, or a mixed emulsified dispersion obtained by mixing and dispersing the wax and the polylactone, may be used.

In a case where an electrification-controlling agent is to be incorporated into the toner in the emulsion polymerization flocculation method, the electrification-controlling agent may be added together with the monomers, etc. at the time of the emulsion polymerization or added in the flocculation step together with the primary particles of the polymer and the colorant, etc., or added after agglomerating the primary particles of the polymer and the colorant, etc. to a proper particle diameter as the toner. Among such methods, it is preferred to emulsify and disperse the electrification-controlling agent in water by using an emulsifying agent and to use it in the form of an emulsion having a volume average particle diameter of from 0.01 to 3 μm. Further, after preparing toner particles, the electrification-controlling agent may be externally added to such particles.

Further, the volume average particle diameter of the above primary particles of the polymer in the dispersion, the dispersed particles of the polylactone, the dispersed particles of the colorant, the dispersed particles of the wax or the dispersed particles of the electrification-controlling agent may be measured by means of e.g. Microtrac UPA (manufactured by Nikkiso CO., LTD).

In the flocculation step in the emulsion polymerization flocculation method, the above-mentioned blend components such as the primary particles of the polymer, the colorant particles, the optional electrification-controlling agent and wax, may be mixed simultaneously or sequentially. However, it is preferred from the viewpoint of the uniformity of the composition and the uniformity of the particle diameter to obtain a mixed dispersion by preliminarily preparing separate dispersions of the respective components, i.e. a dispersion of the primary particles of the polymer, a dispersion of the particles of the colorant, an optional dispersion of the electrification-controlling agent and an optional dispersion of fine particles of wax and mixing them.

The above flocculation treatment may be carried out usually by a method of heating in a stirring vessel, a method of adding an electrolyte, or a method of a combination thereof. In a case where the primary particles are flocculated with stirring to obtain agglomerates of particles close to the size of the toner, the particle diameter of the agglomerates of particles will be controlled by the balance of the flocculation power of the particles to one another and the shearing force by the stirring, but the flocculation force can be increased by heating or by adding an electrolyte.

As an electrolyte to carry out the flocculation by its addition, an organic salt or an inorganic salt may be employed. Specifically, NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ or $C_6H_5SO_3Na$ may, for example, be mentioned. Among them, an inorganic salt having at least bivalent metal cation, is preferred.

The amount of the above electrolyte varies depending upon the type of the electrolyte, the desired particle diameter, etc., but it is usually from 0.05 to 25 parts by weight, preferably from 0.1 to 15 parts by weight, further preferably from 0.1 to 10 parts by weight, per 100 parts by weight of the solid component in the mixed dispersion. If the amount is less than the above range, the flocculation reaction tends to be slow, and there may be a case where a problem will result such that a fine powder of at most 1 μm will remain even after the flocculation reaction, or the average particle diameter of the obtained agglomerates of particles does not reach the desired particle diameter. If it exceeds the above range, the flocculation tends to be rapid, whereby control of the particle diameter tends to be difficult, and there may be a case where a problem will result such that coarse particles or those having irregular shapes will be contained in the obtained agglomerated particles. The flocculation temperature in a case where the flocculation is carried out by adding an electrolyte, is preferably from 20 to 70° C., more preferably from 30 to 60° C.

The flocculation temperature in a case where the flocculation is carried out simply by heating without using an electrolyte, is usually within a temperature range of from lower by 20° C. than Tg of the primary particles of the polymer to Tg, preferably within a range of from lower by 10° C. than Tg to lower by 5° C. than Tg.

The time required for the flocculation is optimized depending upon the shape of the apparatus or the treatment scale, but it is preferred to maintain the above prescribed temperature usually for at least 30 minutes in order to let the particle diameter of the toner particles reach to the desired particle diameter. The temperature may be raised to the prescribed temperature at a constant rate or stepwisely.

In the present invention, on the surface of the agglomerates of particles after the above flocculation treatment, fine particles of a resin may be coated (deposited or fixed) as the case requires, to form toner particles. In the present invention, if the blend amount of the polylactone is increased, while the low temperature fixing property will be improved, the polylactone tends to be exposed at the toner surface, whereby the electrostatic property or heat resistance tends to deteriorate. Such deterioration of the performance may be prevented by coating the surface of the agglomerates of particles with such fine particles of a resin. The volume average particle diameter of the fine particles of a resin is preferably from 0.02 to 3 μm, more preferably from 0.05 to 1.5 μm.

As the fine particles of a resin, those obtained by polymerizing a monomer similar to the monomer employed for the above-described primary particles of the polymer, may be employed. Among them, a crosslinked resin containing a polyfunctional monomer as the raw material is preferred. Further, the fine particles of the resin may contain a polylactone and wax, but from the viewpoint of soiling of the component of the apparatus, it is preferred that they contain neither of them.

Such fine particles of the resin are used usually in the form of a dispersion dispersed in water or in a liquid composed mainly of water by means of an emulsifying agent. However, in a case where the above-mentioned electrification-controlling agent is added after the flocculation treatment, it is preferred that after adding the electrification-controlling agent to the dispersion containing the agglomerates of particles, the fine particles of the resin are added.

In the emulsion polymerization flocculation method, it is preferred to add an aging step to induce fusion among the flocculated particles in order to increase the stability of the agglomerates of particles obtained by the flocculation. The temperature in the aging step is preferably at least Tg of the binder resin constituting the primary particles, more preferably at least a temperature higher by 5° C. than such Tg and preferably at most a temperature higher by 80° C. than such Tg, more preferably at most a temperature higher by 50° C. than such Tg. Further, the time required for such an aging step varies depending upon the shape of the desired toner, but it is usually from 0.1 to 10 hours, preferably from 1 to 6 hours, after reaching at least the glass transition temperature of the polymer constituting the primary particles.

Further, in the emulsion polymerization flocculation method, it is preferred to add an emulsifying agent or to increase the pH value of the flocculation liquid after the above flocculation step, preferably at a stage before or during the aging step. As the emulsifying agent to be used here, it is possible to select and use at least one emulsifying agent from the above-mentioned emulsifying agents which can be used at the time of producing the primary particles of the polymer. It is particularly preferred to employ the same one as the emulsifying agent used at the time of producing the primary particles of the polymer. In a case where the emulsifying agent is to be added, the amount is not particularly limited, but it is preferably at least 0.1 part by weight, more preferably at least 1 part by weight, further preferably at least 3 parts by weight and preferably at most 20 parts by weight, more preferably at most 15 parts by weight, further preferably at most 10 parts by weight, per 100 parts by weight of the solid component in the mixed dispersion. By adding such an emulsifying agent after the flocculation step and before completion of the aging step or by increasing the pH value of the flocculation liquid, it is possible to prevent flocculation of agglomerates of particles flocculated in the flocculation step, and thus it may be possible to prevent formation of coarse particles in the toner after the aging step.

By such a heating treatment, fusion and integration of primary particles one another will take place in the agglomerates, and the shape of the toner particles as such agglomerates will be close to spherical. The agglomerates of particles before the aging step are considered to be agglomerates formed by electrostatic or physical flocculation of primary particles, but after the aging step, the primary particles of the polymer constituting the agglomerates of particles are fused one another, and it is possible to bring the shape of the toner particles to one close to a spherical shape. By such an aging step, by controlling e.g. the temperature and time in the aging step, it is possible to produce toners having various shapes (spherical degrees), such as a grape type of shape wherein the primary particles are flocculated, a potato type wherein the fusion is advanced and a spherical shape wherein the fusion is further advanced, depending upon the particular purposes.

The agglomerates of particles obtained via the above-described various steps, are subjected to solid/liquid separation in accordance with a known method to recover the agglomerates of particles, which are then washed and dried, as the case requires, to obtain the desired toner particles.

Further, it is possible to obtain encapsulated particles by forming an outer layer made mainly of a polymer preferably in a thickness of from 0.01 to 0.5 μm on the surface of particles obtained by the above emulsion polymerization flocculation method by a method such as a spray drying method, an in-situ method or a method for coating particles in a liquid.

In the toner for developing an electrostatic charge image of the present invention, a known auxiliary agent may be added to the surface of toner particles to control the fluidity or the developing property. Such an auxiliary agent may, for example, be a metal oxide or hydroxide, such as alumina, silica, titania, zinc oxide, zirconium oxide, cerium oxide, talc or hydrotalcite, a metal titanate such as calcium titanate, strontium titanate or barium titanate, a nitride such as titanium nitride or silicon nitride, a carbide such as titanium carbide or silicon carbide, or organic particles such as acrylic resin or melamine resin particles. A plurality of such auxiliary agents may be used in combination. Among them, silica, titania or alumina is preferred, and more preferred is one surface-treated with a silane coupling agent or a silicone oil. The average primary particle diameter of such an auxiliary agent is preferably within a range of from 1 to 500 nm, more preferably within a range of from 5 to 100 nm. Further, within such a particle diameter range, one having a small particle diameter and one having a large particle diameter may be used preferably in combination. The total amount of such auxiliary agents is preferably within a range of from 0.05 to 10 parts by weight, more preferably from 0.1 to 5 parts by weight, per 100 parts by weight of the toner particles.

In the present invention, the method for adding the auxiliary agent to the surface of the toner particles may be carried out by uniformly stirring and mixing by means of e.g. a high speed fluidized mixer such as a Henschel mixer (manufactured by Mitsui Mining Co., Ltd.) by suitably setting the shape of vanes, the rotational speed, the time, the number of driving/stopping times, etc. Otherwise, it is possible to fix it to the surface of toner particles by a device capable of imparting a compression shearing stress. The toner for developing an electrostatic charge image of the present invention preferably has a volume average particle diameter (Dv) of from 3 to 9 μm, more preferably from 4 to 8 μm, further preferably from 5 to 7 μm. Further, the lower limit of the content of fine particles having a volume average particle diameter of at most 5.04 μm, is preferably at least 0.1%, more preferably at least 0.5%, particularly preferably at least 1%, and the upper limit is preferably at most 10%, more preferably at most 7%, particularly preferably at most 5%. Further, the content of coarse particles having a volume average particle diameter of at least 12.7 μm, is preferably at most 2%, more preferably at most 1%, particularly preferably at most 0.5%. It is theoretically most preferred that no particles having a volume average particle diameter of at most 5.04 μm or no particles having a volume average particle diameter of at least 12.7 μm, particularly no coarse particles having a volume average particle diameter of at least 17.7 μm, are present, but such is difficult in the practical production, and an installation will be required for a removal step. Accordingly, it is preferred to control the content within the above range. If the volume average particle diameter or the content of particles departs from the above range, there may be a case where such is not suitable for forming an image with a high resolution, and if it is less than the above range, handling as a powder tends to be difficult.

Further, the value (Dv/Dn) obtained by dividing Dv by the number average particle diameter (Dn) is preferably from 1.0 to 1.25, more preferably from 1.0 to 1.20, further preferably from 1.0 to 1.15, and it should better be close to 1.0. With one having a sharp particle size distribution of the toner for developing an electrostatic-charge image, the electrostatic property among solid particles tends to be uniform. Accordingly, Dv/Dn of the toner for developing an electrostatic charge image is preferably within the above range in order to accomplish high image quality and high speed. For the method of measuring the particle diameter of the toner for developing an electrostatic charge image, a commercially available particle size measuring device may be employed, but a precise particle size distribution measuring device Coulter Counter, Multisizer II (manufactured by Beckman Coulter, Inc.) may be employed.

Further, the shape of the toner for developing an electrostatic charge image is preferably as close as possible to a spherical shape, and the 50% circularity as measured by means of a flow type particle image analyzer FPIA-2000 is preferably at least 0.90, more preferably at least 0.92, further preferably at least 0.95. As the shape is closer to a spherical shape, localization of the electrostatic charge in the particles is less likely to take place, and the developing property tends to be uniform. However, it is practically difficult to prepare an absolutely spherical toner. Accordingly, the above-mentioned average circularity is preferably at most 0.995, more preferably at most 0.990.

Further, at least one of peak molecular weights in the gel permeation chromatography (hereinafter sometimes referred to simply as GPC) of the THF soluble content of the toner in the present invention, is preferably at least 30,000, more preferably at least 40,000, further preferably at least 50,000 and preferably at most 200,000, more preferably at most 150,000, further preferably at most 100,000. If each of the peak molecular weights is lower than the above range, the mechanical durability in a non-magnetic one component development system may sometimes deteriorate, and if each of the peak molecular weights is higher than the above range, the low temperature fixing property or fixing strength may sometimes deteriorate, or the transparency as a full color toner may sometimes deteriorate. Here, the THF insoluble content of the toner is preferably at least 10%, more preferably at least 20% and preferably at most 60%, more preferably at most 50%, when measured by a weight method by means of cerite filtration. If it is outside the above range, it may sometimes become difficult to attain both the mechanical durability and the low temperature fixing property or transparency, simultaneously.

The electrostatic property of the toner for developing an electrostatic charge image of the present invention may be a positive electrostatic property or a negative electrostatic property, but it is preferred to use it as a negative electrostatic toner. The electrostatic property of the toner can be controlled by adjusting e.g. the selection and content of the electrification-controlling agent, or the selection and the amount of the auxiliary agent.

Further, the toner for developing an electrostatic charge image of the present invention can be used suitably for any of a black color toner, a color toner and a full color toner.

The toner for developing an electrostatic charge image of the present invention may be used for any of a magnetic two component developer wherein a carrier to transport the toner by a magnetic force to electrostatic latent image portions, is incorporated, or a magnetic one component developer wherein a magnetic powder is incorporated in the toner, or a non-magnetic one component developer wherein no magnetic powder is employed for the developer. However, it is used particularly preferably as a developer for a non-magnetic one component developing system in order to obtain the effects of the present invention remarkably.

In a case where it is used as the above magnetic two component developer, the carrier to be mixed with the toner to form the developer, may, for example, be a known magnetic material such as an iron powder type, ferrite type, magnetite type carrier or one having a resin coating applied to the surface thereof, or a magnetic resin carrier. As the coating resin for the carrier, a styrene resin, an acrylic resin, a styrene/acrylic copolymer resin, a silicone resin, a modified silicone resin or a fluororesin, which is commonly known, may be used, but it is not limited thereto. The average particle diameter of the carrier is not particularly limited, but it is preferably one having an average particle diameter of from 10 to 200 μm. Such a carrier is preferably used in an amount of from 5 to 100 parts by weight per one part by weight of the toner.

The image forming method employing the toner for developing an electrostatic charge image of the present invention is not particularly limited, but it is usually carried out by a basic process wherein an electrostatic latent image formed on the surface of a photoreceptor is developed by a developer containing the above toner for developing an electrostatic charge image and, if necessary, a carrier; the developed non-fixed image is transferred to a fixing substrate; and then, the transferred non-fixed image is fixed.

The material for the photoreceptor is not particularly limited, and it may be a photoreceptor of an inorganic type such as selenium, or an organic photoconductor (OPC). However, it is preferred to employ OPC. In a case where OPC is employed as the photoreceptor, the binder resin is not particularly limited, and it may be one commonly used for OPC. For example, a butadiene resin, a styrene resin, a vinyl acetate resin, a vinyl chloride resin, an acrylate resin, a methacrylate resin, a vinyl alcohol resin, a polymer or copolymer of a vinyl compound such as an ethyl vinyl ether, a polyvinyl butyral resin, a polyvinyl formal resin, a partially modified polyvinyl acetal, a polycarbonate resin, a polyester resin, a polyarylate resin, a polyamide resin, a polyurethane resin, a cellulose ester resin, a phenoxy resin, a silicon resin, a silicon/alkyd resin or a poly-N-vinyl carbazole resin may be mentioned. Among them, a polycarbonate resin or a polyarylate resin is preferred. Further, the shape of the photoreceptor is not limited, and it may be any form such as a drum form, a sheet form or a belt form.

The system for electrostatically charging the photoreceptor is not limited, and it may be any system such as a corona charging system or a contact charging system. However, a contact charging system is preferred with a view to prolonging the durable life of the photoreceptor against deterioration. In a case where the toner for developing an electrostatic charge image of the present invention is used as a developer, filming will be prevented, and even by a contact charging system, the OPC photoreceptor will not be damaged and can be used for a long time. When the contact charging system is employed, the charging means is not particularly limited, but it is preferred to use a charging roller. Further, the material for the charging roller is not particularly limited, but one having an elastic rubber layer provided around a metal core rod is, for example, preferred from the view point of the charging property and not to damage the photoreceptor. The elastic rubber may, for example, be an olefin rubber such as a ethylene/propylene/diene terpolymer (EPDM); a butadiene rubber such as a styrene/butadiene rubber (SBR) or a nitrile/butadiene rubber (NBR); or an urethane rubber such as a thermoplastic urethane or a foamed urethane, and one having carbon dispersed in such an elastic rubber, is preferably employed.

The developing components to be used in the present invention usually comprise components selected from e.g. a developing roller, a component to form a developer layer and a component to stir the toner, and the toner for developing an electrostatic charge image of the present invention, and, if necessary, a carrier, etc. Further, as the developing apparatus in the present invention, a cartridge type is preferably employed. If the toner for developing an electrostatic charge image of the present invention is used as the developer, the toner can be satisfactorily charged even by a system of forming a developer layer on a developing roller by pressing with a developer layer-forming component, and the developing components will not be soiled.

The material for the layer-forming component is not particularly limited, but it may be selected for use among metals such as stainless steel, rubbers such as urethane rubber and silicon rubber and resins such as polyamides.

Further, in the present invention, it is possible to employ a development system such as flight development wherein a photoreceptor and a developed image on a developing sleeve are not in contact, or a development system wherein a photoreceptor and a developed image on a developing sleeve are in contact. However, it is preferred to employ the contact development system with a view to increasing the development efficiency.

In the image forming method of the present invention, an intermediate transfer component may be employed, and in a case where an intermediate transfer component is employed, its shape is not particularly limited, and may be any form such as a drum form, a sheet form or a belt form.

The apparatus and method to fix the transferred non-fixed image are not particularly limited. However, fixing by heat and/or pressure is usually preferred, and it is preferred to employ a press heating system by means of a roller or a film. An oil or the like may be applied to the surface of the roller or the film in order to facilitate-the transfer of the toner to the transfer material. However, when the toner for developing an electrostatic charge image of the present invention is used as a developer, good transfer can be carried out without application of an oil or the like.

In the image forming method of the present invention, the surface of the photoreceptor after the transfer may be cleaned to remove the toner not transferred. The cleaning system is not particularly limited, but it is preferred to employ a cleaning blade. Further, the material for cleaning blade is not particularly limited, but a soft material not to damage the surface of the photoreceptor is preferred, and a rubber blade made of e.g. polyurethane is preferred.

As described in detail in the foregoing, the toner for developing an electrostatic charge image of the present invention can realize low temperature fixing, has a wide fixing temperature range, yet is excellent in the fixing strength and transparency, presents little soiling such as filming on a photoreceptor and is free from soiling of the interior of the apparatus due to deterioration of the electrostatic property. Further, it has a feature that the mechanical durability is high even when it is used for e.g. a non-magnetic one component development system. Usually, in order to secure the durability in a non-magnetic one component development system, the molecular weight of the binder resin is increased to increase the elasticity, and in such a case, although the mechanical strength is improved, the low temperature fixing property tends to deteriorate, and the transparency as a full color toner also tends to deteriorate. However, the fixing aid in the present invention has a sharp melting property and can easily be finely dispersed in the toner particles, whereby the low temperature fixing property and transparency as a toner, and the mechanical durability, can be satisfied simultaneously. Thus, the toner for developing an electrostatic charge image of the present invention is very well suitable for the non-magnetic one component development system and particularly useful as a full color developer in a non-magnetic one component development system. Accordingly, it is suitable as e.g. a full color developer to be used for a non-magnetic one component developing apparatus of a four continuous tandem onepass sequential transfer system. Further, the toner for developing an electrostatic charge image of the present invention presents little filming on the surface resin component (such as polycarbonate) of an organic photoconductor (OPC) and thus is particularly suitable in a contact type development system and most suitable as a full color developer in a contact type non-magnetic one component development system.

EXAMPLES

Now, specific embodiments of the present invention will be described in detail with reference to Examples, but it should be understood that the present invention is by no means restricted by such specific Examples.

In the following Examples, "parts" means "parts by weight". Further, the thermal characteristics, the surface tension, the average particle diameter, the particle size distribution, the tetrahydrofuran (THF) insoluble content, the molecular weight distribution, the circularity, the dispersed particle diameter, the fixing property, the transparency, the electrostatic charge, the blocking resistance and the practicable printability were measured by the following methods, respectively.

Thermal Characteristics of Fixing Aid and Wax

Measured by using DSC120 model manufactured by Seiko Denshi K.K. in a sample amount of 10 mg by raising the temperature at a rate of 10° C./min within a range of from 5 to 120° C. and then, lowering the temperature (cooling) at a rate of 10° C./min, in accordance with JIS K7121. From a graph showing the temperature on the abscissa and the heat balance on the ordinate, the thermal characteristics were determined by the following standards.

(1) Melting point: the peak temperature (° C.) at the fusion peak (2) Half value width of the fusion peak: the peak width (° C.) at a position corresponding to one half of the height of the fusion peak (3) Heat of fusion: calculated from the area of the fusion peak (J/g)

(4) Half value width of crystallization peak: the peak width (° C.) at a position corresponding to one half of the height of the crystallization peak under cooling

Surface Tension of Fixing Aid and Wax

Measured by a contact angle method by Zisman-plot by using four types of liquids i.e. tetrachloroethane, 1-methylnaphthalene, diiodomethane and α-bromonaphthalene.

Volume Average Particle Diameter, Number Average Particle Diameter and Particle Size Distribution of Toner and Particles in Dispersion Measured by optionally using LA-500, manufactured by Horiba K.K., Microtrac UPA (ultraparticle analyzer) manufactured by Nikkiso Co., Ltd and Multisizer II Model (hereinafter referred to simply as Multisizer) manufactured by Beckman Coulter, as particle size distribution measuring machines.

Tetrahydrofuran (THF) Insoluble Content in Toner

One gram of a sample was added to 100 g of THF and left to stand at 25° C. for 24 hours for dissolution, followed by filtration by means of 10 g of sellite, the solvent in the filtrate was distilled off, and the THF soluble content was quantified and subtracted from 1 g to obtain the THF insoluble content.

Peak Molecular Weight of the THF Soluble Content of Toner, and the Number Average Molecular Weight of Fixing Aid Measured by gel permeation chromatography (GPC) by using the filtrate in the above measurement of the THF insoluble content (apparatus: GPC apparatus HLC-8020, manufactured by Tosoh Corporation, column: PL-gel Mixed-B10μ, manufactured by Polymer Laboratory, solvent: THF, sample concentration: 0.1 wt %, calibration curve: standard polystyrene).

Glass Transition Temperature (Tg) of Toner

Measured by DSC7 manufactured by PerkinElmer. The temperature was raised from 30° C. to 100° C. for 7 minutes, then rapidly cooled from 100° C. to −20° C., and then raised from −20° C. to 100° C. for 12 minutes, whereby the value of Tg observed during the second temperature raising period was adopted.

50% Circularity of Toner

The toner was measured by a flow type particle image analyzer ("FPIA-2100" manufactured by Sysmex) and the circularity corresponding to the accumulated 50% value of the values obtained by the following formula was adopted.

Circularity=peripheral length of a circle having the same area as the particle projected area/peripheral length of particle projected image

Electrostatic Charge

A toner was put into a developing tank (ColorPagePrestoN4 developing tank, manufactured by Casio K.K.) of a non-magnetic one component developing apparatus, a developing roller of the developing tank was rotated at a speed of about 150 rpm by a driving device, and then the toner on the roller was suctioned on a filter paper (Whatman Grade 1) by means of a q/m meter (model 210HS, manufactured by TREK JAPAN), whereupon the electrostatic charge per unit weight of the toner was obtained from the capacitance displayed and the weight of the toner suctioned on the filter paper.

Average Dispersed Particle Diameter of Fixing Aid

Toner particles were freeze-cut by e.g. an ultramicrotome and dyed by e.g. ruthenium tetraoxide, and the dispersed particle diameter based on the number of particles was measured by observation of plural visual fields by a transmission electron microscope (TEM). In a case where in addition to polylactone particles, wax particles are dispersed and coexistent in the toner, the measurement was carried out by preparing a toner containing no wax. Further, each dispersed diameter was calculated as the diameter of a circle having the corresponding area.

Blocking Resistance 10 g of a toner for development was put into a cylindrical container, and after putting 20 g of a load thereon, left to stand for 5 hours in an environment of 50° C., whereupon the toner was taken out from the container, and a load was exerted thereon to ascertain the degree of agglomeration.

Good: disintegrated without exerting a load, and no agglomeration was observed.

Practically useful: agglomerated, but disintegrated under a load of less than 50 g.

No good: agglomerated and not disintegrated even under a load of at least 50 g.

Fixing Temperature Range

A recording sheet of A4 size carrying a non-fixed toner image (a strip solid image with a deposition amount of about 0.6 mg/cm$^2$) was prepared and transported to a fixing nip section where the surface temperature of a heating roller was changed from 100° C. to 220° C. by every 5° C., and the fixing state when discharged, was observed. The heating roller of the fixing machine had a core metal being aluminum, an elastic layer being a dimethyl type low temperature vulcanization silicone rubber having a rubber hardness of 3° by JIS-A standards in a thickness of 1.5 mm and a release layer being PFA (a tetrafluroethylene/perfluoroalkyl vinyl ether copolymer) in a thickness of 50 μm and had a diameter of 30 mm and a rubber hardness of the fixing roller surface of 80 as measured in accordance with the standards of Society of Rubber Industry, Japan SRIS 0101. Without applying silicone oil, the test was carried out with a nip width of 4 mm and at a fixing speed of 120 mm/sec. Here, the evaluation range is from 100° C. to 220° C., and with respect to one identified to have the upper limit of the fixing temperature being 220° C., it is possible that the real upper limit of the fixing temperature is higher. Evaluation of the fixing temperature range was made in such a manner that the temperature range wherein no offsetting of the toner takes place on the recording sheet after the fixing and the toner is adequately bonded to the recording sheet, is taken as the fixing temperature range. In this evaluation, a case where the temperature on the low temperature side is not higher than 140° C. and the fixing temperature range (the difference in the fixing temperature between the high temperature side and the low temperature side) is at least 70° C., may be judged as "good".

Fixing Strength Against Bending

A solid image fixed at 150° C. was cut out in a square of 4 cm×4 cm, and the square sample was folded twice along the respective diagonal lines, whereupon the fixing strength was represented by the ratio % of the image density after the bending to the image density before the bending in the vicinity of the intersection of the diagonal lines. A ratio of at least 90% was judged to be good, a ratio of at least 80% and less than 90% was judged to be practically useful, and a ratio of less than 80% was judged to be no good.

Transparency

With respect to each of three colored toners of magenta, cyan and yellow, a non-fixed solid toner image (deposition amount of toner: about 0.6 mg/cm$^2$) on an OHP sheet was fixed by means of the same fixing roller as used for measurement of the fixing temperature range, without applying silicone oil at a fixing speed of 30 mm/sec at 180° C., whereupon the transmittance within the wavelength range of from 400 nm to 700 nm was measured by a spectrophotometer (U-3210, manufactured by Hitachi, Ltd.), and the transparency was evaluated by using a value of the difference (the maximum transmittance minus the minimum transmittance) between the transmittance at a wavelength where the transmittance was highest (the maximum transmittance (%)) and the transmittance at a wavelength where the transmittance was lowest (the minimum transmittance (%)). A case where the transmittance was at least 65%, was judged to be good in transparency.

Practical Evaluation

Using a full color printer of a non-magnetic one component contact developing system (ColorPage PrestoN4, manufactured by Casio K.K.), monochromatic image evaluation and full color image evaluation were carried out.

Preparation of Polylactone Dispersion A 30 parts of polylactone diol having a number average molecular weight of 2,500 (surface tension: 46 mN/m, melting point: 55° C., heat of fusion: 110 J/g, half value width of fusion peak: 8.1° C., half value width of crystallization peak: 5.5° C.) obtained by ring-opening polymerization of ε-caprolactone, 0.3 part of an anionic surfactant (Neogen SC, manufactured by DAI-ICHI KOGYO SEIYAKU CO., LTD.), 0.3 part of polyvinyl alcohol (Gosenol KH17, manufactured by Nippon Gosei Kagaku Kogyo K.K.) and 70 parts of deionized water were heated to 90° C. and stirred for 10 minutes by a disperser. Then, this dispersion was heated to 100° C., and using a homogenizer (15-M-8PA Model, manufactured by Gaulin), emulsifying was initiated under a pressure condition of about 15 MPa and adjusted while sampling was carried out from time to time to measure the average particle diameter by Microtrac UPA, manufactured by Nikkiso Co., Ltd, to prepare a polylactone dispersion A wherein the volume average particle diameter of the polylactone dispersed particles was 0.11 μm.

Preparation of Polylactone Dispersion B

A polylactone dispersion B was prepared in the same manner as in the preparation of the polylactone dispersion A except that polylactone diol having a number average molecular weight of 7,000 (surface tension: 46 mN/m, melting point: 60° C., heat of fusion: 105 J/g, half value width of fusion peak: 8.8° C., half vale width of crystallization peak: 5.9° C.) obtained by ring opening polymerization of ε-caprolactone was used. The volume average particle diameter of the polylactone dispersed particles in the dispersion B was 0.18 μm.

Preparation of Wax Dispersion A 30 parts of an alkyl-modified silicone wax having the following structure (1) (surface tension: 27 mN/m, melting point: 63° C., heat of fusion: 97 J/g, half value width of fusion peak: 10.9° C., half value width of crystallization peak: 17.0° C.), 0.3 part of an anionic surfactant (Neogen SC, manufacture by DAI-ICHI KOGYO SEIYAKU CO., LTD.) and 70 parts of deionized water were heated to 90° C. and stirred for 10 minutes by a disperser. Then, this dispersion was heated to 100° C., and using a homogenizer (15-M-8PA Model, manufactured by Gaulin), emulsifying was initiated under a pressure condition of about 15 MPa, and in the same manner as for the polylactone dispersion, while measurement was carried out by a particle size distribution meter, dispersion was carried out to bring the volume average particle diameter to be about 0.2 μm to prepare a wax dispersion A.

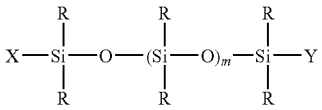

(1)

In the formula (1), R is a methyl group, m is 10, and X═Y=an alkyl group having an average carbon number of 30.

Preparation of Wax Dispersion B

A wax dispersion C for production of a test toner was prepared by dispersing to an average particle diameter of 0.2 μm in the same manner as in the preparation of the wax dispersion A except that a paraffin wax (HNP-11 manufactured by Nippon Seiro K.K., surface tension: 28 mN/m, melting point: 74° C., heat of fusion: 220 J/g, half value width of fusion peak: 8.2° C., half vale width of crystallization peak: 13.0° C.) was used.

Preparation of Colorant Dispersion A 20 parts of carbon black (Mitsubishi Carbon Black MA100S, manufactured by Mitsubishi Chemical Corporation), 1 part of an anionic surfactant (Neogen SC, manufactured by DAI-ICHI KOGYO SEIYAKU CO., LTD.), 5 parts of a non-ionic surfactant (Noigen EA80, manufactured by DAI-ICHI KOGYO SEIYAKU CO., LTD.) and 80 parts of water were dispersed by a sand grinder mill to obtain a black colorant dispersion A. The volume average diameter of the particles measured by Microtrac UPA was about 0.15 μm.

Preparation of Colorant Dispersion B

A colorant dispersion B having a magenta color was obtained in the same manner as in the preparation of the colorant dispersion A except that the carbon black was changed to pigment red 122 (Hostaperm Pink E-WD, manufactured by Clariant Japan). The volume average diameter of the particles was about 0.20 μm.

Preparation of Colorant Dispersion C

A colorant dispersion C having a cyan color was obtained in the same manner as in the preparation of the colorant dispersion A except that the carbon black was changed to pigment blue 15:3 (Hostaperm Blue B2G, manufactured by Clariant Japan). The volume average diameter of particles was about 0.15 μm.

Preparation of Colorant Dispersion D

A colorant dispersion D having a yellow color was obtained in the same manner as in the preparation of colorant dispersion A except that the carbon black was changed to pigment yellow 155 (Novoperm Yellow 4G, manufactured by Clariant Japan). The volume average diameter of particles was about 0.15 μm.

Example 1

A method to obtain a toner by carrying out emulsion polymerization by dropwise adding a monomer to a dispersion of polylactone and wax, followed by flocculation and aging, was carried out as follows:

Preparation of Dispersion A of Primary Particles of Polymer

Into a reactor equipped with a stirring device, a heating/cooling device, a concentrating device and device for charging various raw materials and additives, the following polylactone dispersion A, wax dispersion A and deionized water were charged and heated to 90° C. in a nitrogen stream:

| | |
|---|---|
| Polylactone dispersion A | 20 parts |
| Wax dispersion A | 1 part |
| Deionized water | 365 parts |

Then, while the temperature of the reactor was maintained at 90° C., the following mixture comprising monomers, an aqueous emulsifier solution and a polymerizaiton initiator or the like, was added over a period of 5 hours to carry out emulsion copolymerization using the above polylactone particles and wax particles as seeds.

| | |
|---|---|
| MONOMERS: | |
| Styrene | 79 parts |
| Butyl acrylate | 21 parts |
| Acrylic acid | 3 parts |
| 1,6-hexanediol diacrylate | 1 part |
| Trichlorobromomethane (chain transfer agent) | 1.3 parts |
| AQUEOUS EMULSIFIER SOLUTION: | |
| Aqueous solution containing 10% of emulsifier (Neogen SC) | 12 parts |
| AQUEOUS SOLUTIONS OF INITIATORS: | |
| Aqueous solution containing 8% of hydrogen peroxide | 43 parts |
| Aqueous solution containing 8% of ascorbic acid | 43 parts |

Then, by cooling, a dispersion A of primary particles of a styrene/butyl acrylate/acrylic acid copolymer was obtained. The volume average particle diameter of particles measured by Microtrac UPA manufactured by Nikkiso Co., Ltd. was 0.26 μm.

Preparation of Base Particles A 6 parts of the colorant dispersion A was added to 100 parts of the dispersion A of primary particles of polymer obtained as described above, and with dispersing and stirring by a disperser, an aqueous aluminum sulfate solution was dropwise added (0.5 part as solid content per 100 parts of the dispersion A of primary particles). Then, the temperature was raised to 50° C. over a period of 30 minutes with stirring and maintained at that temperature for one hour, and the temperature was further raised to 52° C. with stirring to carry out the flocculation step. When the volume average particle diameter as agglomerates of primary particles became about 7 μm, an aqueous Neogen SC solution (3 parts as a solid content per 100 parts of the dispersion A of primary particles) was added to terminate the flocculation step. With stirring continuously, the temperature was raised to 97° C. over a period of 50 minutes and maintained at that level for 1.5 hours to carry out the aging step. Then, cooling, filtration, washing with water and drying were carried out to obtain toner base particles A having a black color as an agglomerated and aged product of primary particles.

Preparation of Toner A

To 100 parts of the obtained toner base particles A, 0.5 part of fine particles of silica having an average primary particle diameter of 0.04 μm, subjected to hydrophobic treatment with silicone oil and 2.0 parts of fine particles of silica having an average primary particle diameter of 0.012 μm, subjected to hydrophobic treatment with silicone oil, were added, followed by stirring and mixing by a Henschel mixer to obtain a toner A (black color).

The THF insoluble content of the toner A was about 42 wt %; the peak molecular weight by GPC of the THF soluble content was 55,000; and Tg measured by DSC was 57° C. The volume average diameter (Dv) by a multisizer was 7.2 μm; the proportion of a volume particle diameter of at most 5.04 μm was 3.5%; the proportion of a volume particle diameter of at least 12.7 μm was 0.0%; the value (Dv/Dn) obtained by dividing the volume average particle diameter (Dv) by the number average diameter (Dn) was 1.11. Further, the 50% circularity was 0.97; and the electrostatic charge of the toner A was −15 μC/g. The average dispersed particle diameter of the polylactone particles was measured by using toner particles preliminarily prepared in the same manner without using wax and found to be about 0.1 μm.

The blocking resistance of the toner was "good". Further, in the fixing evaluation, the fixing temperature range was from 135 to 220° C., and the fixing strength against bending was 94%. Thus, the low temperature fixing property and the fixing strength were good.

About 200 g of the toner A was put into a black developing apparatus of a tandem type full color printer of a contact type non-magnetic one component development system (ColorPagePrestoN4 manufactured by Casio K.K.) having a OPC photoreceptor, and practical evaluation was carried out by about 6,000 sheets of a monochromatic image by a 5% printing pattern, whereby to the finish time, the image quality with respect to the image density, fogging, resolution, etc. was good, and a clear black color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 2

Base particles B having a magenta color were obtained in the same manner as in Example 1 except that the colorant dispersion B was used instead of the colorant dispersion A, and then, the toner B having a magenta color was obtained in the same manner as in Example 1.

With respect to the obtained toner B, the measurements were carried out in the same manner as in Example 1, and the results are shown in Table 2, and the results of the blocking resistance, the fixing temperature range and the fixing strength against bending evaluated in the same manner as in Example 1 are shown in Table 3. Further, the transparency was good at 72%.

Practical evaluation was carried out by a monochromatic image of about 6,000 sheets in the same manner as in Example 1 except that about 200 g of the toner B was put into a magenta developing apparatus, whereby to the finish time, the image quality with respect to the image density, fogging, resolution, etc. was good, and a clear magenta color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 3

Base particles C of a cyan color were obtained in the same manner as in Example 1 except that the colorant dispersion C was used instead of the colorant dispersion A, and then, a toner C having a cyan color was obtained in the same manner as in Example 1.

With respect to the obtained toner C, the measurements were carried out in the same manner as in Example 1, and the results are shown in Table 2, and the results of the blocking resistance, the fixing temperature range and the fixing strength against bending evaluated in the same manner as in Example 1, are shown in Table 3. Further, the transparency was good at 76%.

Practical evaluation was carried out by a monochromatic image of about 6,000 sheets in the same manner as in Example 1 except that about 200 g of the toner C was put into a cyan developing apparatus, whereby to the finish time, the image quality with respect to the image density, fogging, resolution, etc., was good, and a clear cyan color was obtained. During such an operation, there was no soiling of the image due to filming on the photoreceptor or no soiling of the interior of the apparatus due to deterioration of the electrostatic charge of the toner. Further, there was no fusion of the toner to the developing roller or blade of the non-magnetic one component developing apparatus, and the mechanical durability was also good.

Example 4

Base particles D having an yellow color were obtained in the same manner as in Example 1 except that the colorant dispersion D was used instead of the colorant dispersion A, and then, a toner D having an yellow color was obtained in the same manner as in Example 1.

With respect to the obtained toner D, the measurements were carried out in the same manner as in Example 1, and the results are shown in Table 2, and the results of the blocking resistance, the fixing temperature range and the fixing strength against bending evaluated in the same manner as in Example 1, are shown in Table 3. Further, the transparency was good at 71%.

Practical evaluation was carried out by a monochromatic image of about 6,000 sheets in the same manner as in Example 1 except that about 200 g of the toner D was put into an yellow developing apparatus, whereby up to the finish time, the image quality with respect to the image density, fogging, resolution, etc., was good, and a clear yellow color was obtained. During such an operation, there was no soiling of the image due to filming on the photoreceptor or no soiling of the interior of the apparatus due to deterioration of the electrostatic charge of the toner. Further, there was no fusion of the toner to the developing roller or blade of the non-magnetic one component developing apparatus, and the mechanical durability was also good.

Examples 5 to 12, and Comparative Examples 1 to 4

Toners E to P having various colors as identified in Table 1, were obtained in the same manner as in Example 1 except that the polylactone dispersion, the wax dispersion and the colorant dispersion as identified in Table 1 were used. At an intermediate point, the volume average particle diameter of the dispersion of primary particles of polymer was measured by Microtrac UPA manufactured by Nikkiso Co., Ltd., and the results are shown in Table 1. The measurements and evaluations were carried out in the same manner as in Example 1, and the results are shown in Tables 2 and 3.

In Comparative Examples 1 to 4 (toners M, N, O and P) wherein no polylactone dispersion was used, there were problems with respect to the fixing temperature range or the fixing strength, and the transparency was also inferior to Examples. Further, in practical evaluation by the non-magnetic one component developing system, scattering in the apparatus was observed at a level of about 3,000 sheets with each toner, and it was assumed that there was a problem in the electrostatic stability as a toner.

TABLE 1

| | Toner | Color | Polylactone dispersion Type | Polylactone dispersion Parts | Wax dispersion Type | Wax dispersion Parts | Colorant dispersion Type | Volume average diameter of primary particles of polymer (μm) |
|---|---|---|---|---|---|---|---|---|
| Ex. 1 | A | Black | A | 20 | A | 1 | A | 0.26 |
| Ex. 2 | B | Magenta | A | 20 | A | 1 | B | 0.26 |
| Ex. 3 | C | Cyan | A | 20 | A | 1 | C | 0.26 |
| Ex. 4 | D | Yellow | A | 20 | A | 1 | D | 0.26 |
| Ex. 5 | E | Black | B | 20 | A | 1 | A | 0.28 |
| Ex. 6 | F | Magenta | B | 20 | A | 1 | B | 0.28 |
| Ex. 7 | G | Cyan | B | 20 | A | 1 | C | 0.28 |
| Ex. 8 | H | Yellow | B | 20 | A | 1 | D | 0.28 |
| Ex. 9 | I | Black | A | 20 | B | 15 | A | 0.21 |
| Ex. 10 | J | Magenta | A | 20 | B | 15 | B | 0.21 |
| Ex. 11 | K | Cyan | A | 20 | B | 15 | C | 0.21 |
| Ex. 12 | L | Yellow | A | 20 | B | 15 | D | 0.21 |
| Comp. Ex. 1 | M | Black | Not used | | A | 1 | A | 0.23 |
| Comp. Ex. 2 | N | Magenta | Not used | | A | 1 | B | 0.23 |
| Comp. Ex. 3 | O | Cyan | Not used | | A | 1 | C | 0.23 |
| Comp. Ex. 4 | P | Yellow | Not used | | A | 1 | D | 0.23 |

TABLE 2

| | Toner | Color | THF insoluble content (wt %) | Molecular weight peak by GPC of THF soluble content | Tg (° C.) | Dv (μm) | Volume particle diameter of at most 5.04 μm (%) | Volume particle diameter of at least 12.7 μm (%) | Dv/Dn | 50% circularity | Electrostatic charge (μC/g) | Average dispersed particle diameter of polylactone particles (μm) |
|---|---|---|---|---|---|---|---|---|---|---|---|---|
| Ex. 1 | A | Black | About 42 | 55000 | 57 | 7.2 | 3.5 | 0 | 1.11 | 0.97 | −15 | 0.1 |
| Ex. 2 | B | Magenta | About 45 | 58000 | 55 | 7.0 | 4.2 | 0 | 1.12 | 0.96 | −14 | 0.1 |
| Ex. 3 | C | Cyan | About 40 | 55000 | 58 | 7.3 | 3.9 | 0 | 1.13 | 0.97 | −17 | 0.1 |
| Ex. 4 | D | Yellow | About 40 | 55000 | 58 | 7.3 | 4.0 | 0 | 1.11 | 0.97 | −15 | 0.1 |
| Ex. 5 | E | Black | About 38 | 52000 | 59 | 7.1 | 4.4 | 0 | 1.12 | 0.97 | −18 | 0.1 |
| Ex. 6 | F | Magenta | About 38 | 55000 | 56 | 7.1 | 4.6 | 0 | 1.11 | 0.97 | −15 | 0.1 |
| Ex. 7 | G | Cyan | About 40 | 51500 | 58 | 7.3 | 4.0 | 0 | 1.12 | 0.97 | −19 | 0.1 |
| Ex. 8 | H | Yellow | About 40 | 54000 | 56 | 7.5 | 3.5 | 0 | 1.14 | 0.97 | −17 | 0.1 |
| Ex. 9 | I | Black | About 43 | 55000 | 58 | 7.2 | 3.7 | 0 | 1.12 | 0.96 | −14 | 0.1 |
| Ex. 10 | J | Magenta | About 35 | 54000 | 55 | 7.2 | 3.9 | 0 | 1.12 | 0.97 | −13 | 0.1 |
| Ex. 11 | K | Cyan | About 40 | 53000 | 57 | 7.1 | 4.4 | 0 | 1.12 | 0.97 | −14 | 0.1 |
| Ex. 12 | L | Yellow | About 41 | 51000 | 57 | 7.2 | 4.4 | 0 | 1.11 | 0.97 | −15 | 0.1 |
| Comp. Ex. 1 | M | Black | About 40 | 54000 | 60 | 7.1 | 4.0 | 0 | 1.12 | 0.97 | −18 | Not used |
| Comp. Ex. 2 | N | Magenta | About 42 | 56500 | 58 | 7.1 | 4.4 | 0 | 1.12 | 0.97 | −13 | Not used |
| Comp. Ex. 3 | O | Cyan | About 39 | 52000 | 61 | 7.2 | 4.4 | 0 | 1.12 | 0.97 | −15 | Not used |
| Comp. Ex. 4 | P | Yellow | About 38 | 53500 | 61 | 7.1 | 4.5 | 0 | 1.13 | 0.97 | −18 | Not used |

TABLE 3

| | Toner | Color | Blocking resistance | Fixing temperature range (° C.) | Fixing strength against bending (%) | Transparency (%) | Practical durability 6,000 sheets |
|---|---|---|---|---|---|---|---|
| Ex. 1 | A | Black | Good | 135 to 220 | 94 | — | Good |
| Ex. 2 | B | Magenta | Good | 135 to 220 | 92 | 72 | Good |
| Ex. 3 | C | Cyan | Good | 135 to 220 | 94 | 76 | Good |
| Ex. 4 | D | Yellow | Good | 135 to 220 | 94 | 71 | Good |
| Ex. 5 | E | Black | Good | 140 to 220 | 90 | — | Good |
| Ex. 6 | F | Magenta | Good | 140 to 220 | 88 | 68 | Good |

TABLE 3-continued

| | Toner | Color | Blocking resistance | Fixing temperature range (° C.) | Fixing strength against bending (%) | Transparency (%) | Practical durability 6,000 sheets |
|---|---|---|---|---|---|---|---|
| Ex. 7 | G | Cyan | Good | 140 to 220 | 89 | 72 | Good |
| Ex. 8 | H | Yellow | Good | 140 to 220 | 91 | 68 | Good |
| Ex. 9 | I | Black | Good | 140 to 220 | 92 | — | Good |
| Ex. 10 | J | Magenta | Good | 140 to 220 | 92 | 70 | Good |
| Ex. 11 | K | Cyan | Good | 140 to 220 | 94 | 75 | Good |
| Ex. 12 | L | Yellow | Good | 140 to 220 | 95 | 73 | Good |
| Comp. Ex. 1 | M | Black | Good | 155 to 220 | 78 | — | Scattering observed after 3,000 sheets |
| Comp. Ex. 2 | N | Magenta | Good | 160 to 220 | 76 | 66 | Scattering observed after 3,000 sheets |
| Comp. Ex. 3 | O | Cyan | Good | 160 to 220 | 78 | 65 | Scattering observed after 3,000 sheets |
| Comp. Ex. 4 | P | Yellow | Good | 160 to 220 | 77 | 67 | Scattering observed after 3,000 sheets |

Example 13

Toners A, B, C and D corresponding to black, magenta, cyan and yellow, respectively, were charged into a four color developing apparatus of a tandem type full color printer of a contact type non-magnetic one component developing system (Color Page Presto N4, manufactured by Casio K.K.), and then, a full color image was formed continuously about 200 times by a pattern of identification number N5 stipulated in JIS X9201; 2001 (high-definition color digital standard image), and the image was evaluated.

As a result, up to 200 sheets from the initial stage, the image quality with respect to the image density, fogging, resolution, etc. was good, and a clear full color image was obtained. During such an operation, there was no soiling of the image due to filming on the photoreceptor or no soiling in the interior of the apparatus due to deterioration of the electrostatic charge of the toner, and there was no fusion of the toner to the developing roller or blade of the non-magnetic one component developing apparatus, and the mechanical durability was also good.

Example 14

A full color image was continuously formed about 200 times in the same manner as in Example 13 except that toners E, F, G and H were charged instead of using toners A, B, C and D, and the image was evaluated. As a result, up to 200 sheets from the initial stage, the image quality with respect to the image density, fogging, resolution, etc. was good, and a clear full color image was obtained. During such an operation, there was no soiling of the image due to filming on a photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 15

A full color image was continuously formed about 200 times in the same manner as in Example 13 except that toners I, J, K and L were charged instead of using toners A, B, C and D, and the image was evaluated.

As a result, up to 200 sheets from the initial stage, the image quality with respect to the image density, fogging, resolution, etc. was good, and a clear full color image was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 16

A method to obtain a toner by carrying out emulsion polymerization by dropwise adding a polylactone and a monomer to a wax dispersion, followed by flocculation and aging, was carried out as follows:

Preparation of Dispersion Q of Primary Particles of Polymer

Into a reactor equipped with a stirring device, a heating/cooling device, a concentrating device, and a device for charging various raw materials and additives, the following wax dispersion A and dehydrolyzed water were charged, and the temperature was raised to 90° C. in a nitrogen stream:

| | |
|---|---|
| Wax dispersion A | 1 part |
| Dehydrolyzed water | 365 parts |

Then, in the following formulation amounts, polylactone (one having a number average molecular weight of 2,500 and a melting point of 55° C., obtained by ring opening polymerization of ϵ-caprolactone) was added to monomers, then, a mixture comprising such a mixture and the following aqueous emulsifier solution and aqueous polymerization initiator solution or the like, was added over a period of 5 hours, and emulsion copolymerization was carried out by using the above wax particles as seeds.

| | |
|---|---|
| POLYLACTONE | 5 parts |
| MONOMERS: | |
| Styrene | 79 parts |
| Butyl acrylate | 21 parts |
| Acrylic acid | 3 parts |
| 1,6-Hexanediol diacrylate | 1 part |

-continued

| | |
|---|---|
| Trichlorobromomethane (chain transfer agent) | 1.3 parts |
| AQUEOUS EMULSIFIER SOLUTION: | |
| Aqueous solution containing 10% of emulsifier (Neogen SC) | 12 parts |
| Polyvinyl alcohol (GOHSENOL KH17, manufactured by The Nippon Synthetic Chemical Industry Co., Ltd.) | 0.3 parts |
| AQUEOUS INITIATOR SOLUTION: | |
| Aqueous solution containing 8% of hydrogen peroxide | 43 parts |
| Aqueous solution containing 8% of ascorbic acid | 43 parts |

Then, by cooling, a dispersion Q of primary particles of a styrene/butyl acrylate/acrylic acid copolymer was obtained. The volume average particle diameter of particles measured by Microtrac UPA manufactured by Nikkiso Co., Ltd. was 0.25 μm.

Preparation of Toner Q

Base particles Q having a black color were obtained in the same manner as in Example 1 except that the dispersion Q of primary particles of polymer obtained as described above was used instead of the dispersion A of primary particles of polymer, and then, a toner Q having a black color was obtained in the same manner as in Example 1.

With respect to the obtained toner Q, the measurements were carried out in the same manner as in Example 1, and the results are shown in Table 5, and the results of the blocking resistance, the fixing temperature range and the fixing strength against bending evaluated in the same manner as in Example 1, are shown in Table 6.

Practical evaluation was carried out by a monochromatic image of about 6,000 sheets in the same manner as in Example 1 except that about 200 g of the toner Q was put into a black developing apparatus, whereby to the finish time, the image quality with respect to the image density, fogging, resolution, etc. was good, and a clear black color was obtained. During such an operation, there was no soiling of the image due to filming on the photoreceptor or no soiling of the interior of the apparatus due to deterioration of the electrostatic charge of-the toner, and there was no fusion of the toner to the developing roller or blade of the non-magnetic one component developing apparatus, and the mechanical durability was also good.

Example 17

Base particles R having a magenta color were obtained in the same manner as in Example 16 except that the colorant dispersion B was used instead of the colorant dispersion A, and then, a toner R having a magenta color was obtained in the same manner as in Example 16.

With respect to the obtained toner R, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 73%.

Practical evaluation was carried out by a monochromatic image of about 6,000 sheets in the same manner as in Example 1 except that about 200 g of the toner R was put into a magenta developing apparatus, whereby to the finish time, the image quality with respect to the image density, fogging, resolution, etc. was good, and a clear magenta color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 18

Base particles S having a cyan color were obtained in the same manner as in Example 16 except that the colorant dispersion C was used instead of the colorant dispersion A, and then, a toner S having a cyan color was obtained in the same manner as in Example 16.

With respect to the obtained toner S, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 77%.

Practical evaluation was carried out by a monochromatic image of about 6,000 sheets in the same manner as in Example 1 except that about 200 g of the toner S was put into a cyan developing apparatus, whereby to the finish time, the image quality with respect to the image density, fogging, resolution, etc. was good, and a clear cyan color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 19

Base particles T having an yellow color were obtained in the same manner as in Example 16 except that the colorant dispersion D was used instead of the colorant dispersion A, and then, a toner T having an yellow color was obtained in the same manner as in Example 16.

With respect to the obtained toner T, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 70%.

Practical evaluation was carried out by a monochromatic image of about 6,000 sheets in the same manner as in Example 1 except that about 200 g of the toner T was put into an yellow developing apparatus, whereby to the finish time, the image quality with respect to the image density, fogging, resolution, etc. was good, and a clear yellow color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 20

A full image color was continuously formed about 200 times in the same manner as in Example 13 except that toners Q, R, S and T were charged instead of toners A, B, C and D, and the image was evaluated.

As a result, up to 200 sheets from the initial stage, the image quality with respect to the image density, fogging resolution, etc. was good, and a clear full color image was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 21

A method to obtain a toner by carrying out emulsion polymerization by dropwise adding a monomer to the polylactone dispersion and then adding a wax dispersion, followed by flocculation and aging, was carried out as follows:

Preparation of Dispersion U of Primary Particles of Polymer

Into a reactor equipped with a stirring device, a heating/cooling device, a concentrating device and a device for charging various raw materials and additives, the following polylactone dispersion A and deionized water were charged, and the temperature was raised to 90° C. in a nitrogen stream.

| | |
|---|---|
| Polylactone dispersion A | 20 Parts |
| Deionized water | 365 parts |

Then, while the temperature of the reactor was maintained at 90° C., a mixture comprising the following monomers, aqueous emulsifier solution and the polymerization initiator or the like, was added over a period of 5 hours and emulsion copolymerization was carried out by using the above polylactone particles as seeds.

| | |
|---|---|
| MONOMERS: | |
| Styrene | 79 parts |
| Butyl acrylate | 21 parts |
| Acrylic acid | 3 parts |
| 1,6-Hexanediol diacrylate | 1 part |
| Trichlorobromomethane (chain transfer agent) | 1.3 parts |
| AQUEOUS EMULSIFIER SOLUTION: | |
| Aqueous solution containing 10% of emulsifier (Neogen SC) | 12 parts |
| AQUEOUS INITIATOR SOLUTION: | |
| Aqueous solution containing 8% of hydrogen peroxide | 43 parts |
| Aqueous solution containing 8% of ascorbic acid | 43 parts |

Then, by cooling, a dispersion U of primary particles of a styrene/butyl acrylate/acrylic acid copolymer was obtained. The volume average particle diameter of particles measured by Microtrac UPA manufactured by Nikkiso Co., Ltd was 0.26 μm.

Preparation of Toner U

To 100 parts of the dispersion U of primary particles of polymer obtained as described above, 1 part of the wax dispersion A and 6 parts of the colorant dispersion A were added, and with dispersing and stirring by a disperser, an aqueous aluminum sulfate solution (0.5 part as a solid content per 100 parts of the dispersion U of primary particles) was dropwise added, and the temperature was raised to 50° C. over a period of 30 minutes with stirring and then maintained at that level for one hour. Further, the temperature was raised to 52° C. with stirring to carry out the flocculation step. When the volume average particle diameter as the agglomerates of primary particles became about 7 μm, an aqueous Neogen SC solution (3 parts as a solid content per 100 parts of the dispersion U of primary particles) was added to terminate the flocculation step, and the temperature was continuously raised to 97° C. over a period of 50 minutes with stirring and maintained at the same level for 1.5 hours to carry out the aging step. Then, cooling, filtration, washing with water and drying were carried out to obtain toner base particles U having a black color as an agglomerated aged product of primary particles.

Then, a toner U having a black color was obtained in the same manner as in Example 1.

With respect to the obtained toner U, the measurements were carried out in the same manner as in Example 1, and the results are shown in Table 5, and the results of the blocking resistance, the fixing temperature range and the fixing strength against bending evaluated in the same manner as in Example 1, are shown in Table 6.

Practical evaluation was carried out by a monochromatic image of about 6,000 sheets in the same manner as in Example 1 except that about 200 g of the toner U was put into a black developing apparatus, whereby to the finish time, the image quality with respect to the image density, fogging, resolution, etc. was good, and a clear black color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 22

Base particles V having a magenta color were obtained in the same manner as in Example 21 except that the colorant dispersion B was used instead of the colorant dispersion A, and then, a toner V having a magenta color was obtained in the same manner as in Example 21.

With respect to the obtained toner V, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 70%.

Practical evaluation was carried out by a monochromatic image of about 6,000 sheets in the same manner as in Example 1 except that about 200 g of the toner V was put into a magenta developing apparatus, whereby to the finish time, the image quality with respect to the image density, fogging, resolution, etc. was good, and a clear magenta color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 23

Base particles W having a cyan color were obtained in the same manner as in Example 21 except that the colorant dispersion C was used instead of the colorant dispersion A, and then, a toner W having a cyan color was obtained in the same manner as in Example 21.

With respect to the obtained toner W, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 71%.

Practical evaluation was carried out by a monochromatic image of about 6,000 sheets in the same manner as in Example 1 except that about 200 g of the toner W was put into a cyan developing apparatus, whereby to the finish time, the image quality with respect to the image density, fogging, resolution, etc. was good, and a clear cyan color was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one component developing apparatus, and the mechanical durability was also good.

Example 24

Base particles X having an yellow color were obtained in the same manner as in Example 21 except that the colorant dispersion D was used instead of the colorant dispersion A, and then, a toner X having an yellow color was obtained in the same manner as in Example 21.

With respect to the obtained toner X, the measurements were carried out in the same manner as in Example 1, and the results are shown in Table 5, and the results of the blocking resistance, the fixing temperature range and the fixing strength against bending evaluated in the same manner as in Example 1, are shown in Table 6. Further, the transparency was good at 71%. Practical evaluation was carried out by a monochromatic image of about 6,000 sheets in the same manner as in Example 1 except that about 200 g of the toner T was put into an yellow developing apparatus, whereby to the finish time, the image quality with respect to the image density, fogging, resolution, etc. was good, and a clear yellow color was obtained. During such an operation, there was no soiling of the image due to filming on the photoreceptor of no soiling of the interior of the apparatus due to deterioration of the electrostatic charge of the toner, and there was no fusion of the toner to the developing roller or blade of the non-magnetic one component developing apparatus, and the mechanical durability was also good.

Example 25

A full color image was continuously formed about 200 times in the same manner as in Example 13 except that toners U, V, W and X were charged instead of using toners A, B, C and D, and the image was evaluated.

As a result, up to 200 sheets from the initial stage, the image quality with respect to the image density, fogging, resolution, etc. was good, and a clear full color image was obtained. During such an operation, there was no soiling of the image due to filming on the photoreceptor or no soiling of the interior of the apparatus due to deterioration of the electrostatic charge of the toner, and there was no fusion of the toner to the developing roller or blade of the non-magnetic one components developing apparatus, and the mechanical durability was also good.

TABLE 4

| | | | Polylactone dispersion | | Wax dispersion | | Colorant dispersion | Volume average diameter of primary particles of polymer |
|---|---|---|---|---|---|---|---|---|
| | Toner | Color | Type | Parts | Type | Parts | Type | (μm) |
| Ex. 16 | Q | Black | Not used | | A | 1 | A | 0.25 |
| Ex. 17 | R | Magenta | Not used | | A | 1 | B | 0.25 |
| Ex. 18 | S | Cyan | Not used | | A | 1 | C | 0.25 |
| Ex. 19 | T | Yellow | Not used | | A | 1 | D | 0.25 |
| Ex. 21 | U | Black | A | 20 | A | 1 | A | 0.26 |
| Ex. 22 | V | Magenta | A | 20 | A | 1 | B | 0.26 |
| Ex. 23 | W | Cyan | A | 20 | A | 1 | C | 0.26 |
| Ex. 24 | X | Yellow | A | 20 | A | 1 | D | 0.26 |

TABLE 5

| | Toner | Color | THF insoluble content (wt %) | Molecular weight peak by GPC of THF soluble content | Tg (° C.) | Dv (μm) | Volume particle diameter of at most 5.04 μm (%) | Volume particle diameter of at least 12.7 μm (%) | Dv/Dn | 50% circularity | Electro-static charge (μC/g) | Average dispersed particle diameter of polylactone particles (μm) |
|---|---|---|---|---|---|---|---|---|---|---|---|---|
| Ex. 16 | Q | Black | About 49 | 60000 | 55 | 6.9 | 5.0 | 0 | 1.10 | 0.97 | −20 | 0.1 |
| Ex. 17 | R | Magenta | About 42 | 52000 | 54 | 7.5 | 2.9 | 0 | 1.12 | 0.97 | −15 | 0.1 |
| Ex. 18 | S | Cyan | About 43 | 54500 | 55 | 7.1 | 4.1 | 0 | 1.12 | 0.97 | −16 | 0.1 |
| Ex. 19 | T | Yellow | About 43 | 51000 | 56 | 7.5 | 2.7 | 0 | 1.11 | 0.97 | −18 | 0.1 |
| Ex. 21 | U | Black | About 38 | 50500 | 53 | 7.7 | 2.0 | 0 | 1.14 | 0.97 | −14 | 0.1 |
| Ex. 22 | V | Magenta | About 40 | 51000 | 55 | 7.5 | 1.8 | 0 | 1.14 | 0.97 | −15 | 0.1 |
| Ex. 23 | W | Cyan | About 36 | 50000 | 55 | 7.7 | 1.5 | 0 | 1.13 | 0.97 | −14 | 0.1 |
| Ex. 24 | X | Yellow | About 38 | 50000 | 57 | 7.6 | 2.0 | 0 | 1.13 | 0.97 | −15 | 0.1 |

TABLE 6

| | Toner | Color | Blocking resistance | Fixing temperature range (° C.) | Fixing strength against bending (%) | Transparency (%) | Practical durability 6,000 sheets |
|---|---|---|---|---|---|---|---|
| Ex. 16 | Q | Black | Good | 140 to 220 | 92 | — | Good |
| Ex. 17 | R | Magenta | Good | 140 to 220 | 90 | 73 | Good |
| Ex. 18 | S | Cyan | Good | 140 to 220 | 90 | 77 | Good |
| Ex. 19 | T | Yellow | Good | 140 to 220 | 94 | 70 | Good |
| Ex. 21 | U | Black | Good | 140 to 220 | 85 | — | Good |
| Ex. 22 | V | Magenta | Good | 140 to 220 | 95 | 70 | Good |
| Ex. 23 | W | Cyan | Good | 140 to 220 | 87 | 71 | Good |
| Ex. 24 | X | Yellow | Good | 140 to 220 | 85 | 71 | Good |

INDUSTRIAL APPLICABILITY

The toner for developing an electrostatic charge image of the present invention is useful in an application to high speed printing, since the fixing aid contained in the toner will be melted quickly at the time of heating for fixing and will be solidified quickly after the fixing. Further, the fixing aid in the toner is finely dispersed, whereby leaching out of the fixing aid from the toner will be prevented. Thus, the toner is useful in a case where a long term storage stability is required or in a case where it is used under severe conditions such as high temperature, high humidity, etc.

The entire disclosure of Japanese Patent Application No. 2003-197996 filed on Jul. 16,-2003 including specification, claims and summary is incorporated herein by reference in its entirety.

What is claimed is:

1. A toner for developing an electrostatic charge image, comprising particles containing a binder resin and a colorant, wherein the particles contain a fixing aid having a melting point of from 30 to 100° C. and a surface tension of at least 39 mN/m, the fixing aid is present with an average particle diameter of at most 1 μm internally in the particles, and when the fixing aid is a caprolactone derivative, it is a caprolactone diol or a caprolactone triol, wherein the fixing aid has a crystallization peak with a half value width of at most 12° C.

2. The toner for developing an electrostatic charge image according to claim 1, wherein the surface tension of the fixing aid is at least 42 mN/m.

3. The toner for developing an electrostatic charge image according to claim 1, wherein the fixing aid has a fusion peak with a half value width of at most 10° C.

4. The toner for developing an electrostatic charge image according to claim 1, wherein the fixing aid is a compound having a number average molecular weight of from 500 to 60,000 and hydroxyl groups.

5. The toner for developing an electrostatic charge image according to claim 1, wherein the fixing aid is a polylactone.

6. The toner for developing an electrostatic charge image according to claim 1, which is produced by a wet system polymerization method.

7. The toner for developing an electrostatic charge image according to claim 1, which is produced by an emulsion polymerization flocculation method.

8. The toner for developing an electrostatic charge image according to claim 1, which contains wax.

9. The toner for developing an electrostatic charge image according to claim 1, which is obtained by a process of flocculating colorant particles and polymer primary particles containing the fixing aid to form agglomerates of particles.

10. The toner for developing an electrostatic charge image according to claim 8, which is obtained by a process of flocculating colorant particles and polymer primary particles containing the fixing aid and wax to form agglomerates of particles.

11. The toner for developing an electrostatic charge image according to claim 8, which is obtained by a process of flocculating polymer primary particles containing the fixing aid, colorant particles and fine particles of wax to form agglomerates of particles.

12. A method comprising developing an electrostatic charge image formed by full color with the toner according to claim 1.

13. A method comprising developing an electrostatic charge image in a contact developing system with the toner according to claim 1.

14. A method comprising fixing an image using a toner for developing an electrostatic charge image as a developer, wherein the toner comprises particles containing a binder resin and a colorant, wherein the particles contain a fixing aid having a melting point of from 30 to 100° C. and a surface tension of at least 39 mN/m, the fixing aid is present with an average particle diameter of at most 1 μm internally in the particles, and when the fixing aid is a caprolactone derivative, it is a caprolactone diol or a caprolactone triol, wherein the fixing aid has a crystallization peak with a half value width of at most 12° C.

15. The toner for developing an electrostatic charge image according to claim 7, wherein a polymerizable monomer and the fixing aid are mixed; the fixing aid is finely dispersed in the monomer, and then the monomer is emulsion-polymerized to obtain a dispersion containing primary particles of the polymer.

16. The toner for developing an electrostatic charge image according to claim 7, wherein a dispersion obtained by dispersing the fixing aid in a medium is used as seeds, and a polymerizable monomer is dropwise added thereto to carry out emulsion polymerization to obtain primary particles of the polymer internally containing the fixing aid.

17. A toner for developing an electrostatic charge image, comprising particles containing a binder resin and a colorant, wherein the particles contain a fixing aid having a melting point of from 30 to 100° C. and a surface tension of at least 39 mN/m, the fixing aid and the binder being different components, the fixing aid is present with an average particle diameter of at most 1 μm internally in the particles, and when the fixing aid is a caprolactone derivative, it is a caprolactone diol or a caprolactone triol.

18. A toner for developing an electrostatic charge image, comprising particles containing a binder resin and a colorant, wherein the particles contain a fixing aid having a melting point of from 30 to 70° C. and a surface tension of at least 39 mN/m, the fixing aid is present with an average particle diameter of at most 1 μm internally in the particles, and when the fixing aid is a caprolactone derivative, it is a caprolactone diol or a caprolactone triol.

19. A toner for developing an electrostatic charge image, comprising particles containing a binder resin and a colorant, wherein the particles contain a fixing aid having a melting point of from 30 to 100° C. and a surface tension of at least 42 mN/in, the fixing aid is present with an average particle diameter of at most 1 μm internally in the particles, and when the fixing aid is a caprolactone derivative, it is a caprolactone diol or a caprolactone triol.

* * * * *